US007310492B2

(12) United States Patent
Kimura

(10) Patent No.: US 7,310,492 B2
(45) Date of Patent: Dec. 18, 2007

(54) FIXING DEVICE HAVING RELEASE AGENT APPLYING UNIT AND IMAGE FORMING APPARATUS

(75) Inventor: Taku Kimura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 39 days.

(21) Appl. No.: 11/188,178

(22) Filed: Jul. 22, 2005

(65) Prior Publication Data

US 2006/0024096 A1 Feb. 2, 2006

(30) Foreign Application Priority Data

Jul. 30, 2004 (JP) ..... 2004-223237

(51) Int. Cl.
*G03G 15/20* (2006.01)

(52) U.S. Cl. ..... 399/325; 399/12

(58) Field of Classification Search ..... 399/320, 399/324, 325, 326, 12, 122; 219/216
See application file for complete search history.

(56) References Cited

U.S. PATENT DOCUMENTS 5,800,908 A * 9/1998 Hobson et al. ..... 428/198
6,751,424 B2 * 6/2004 Komatsu et al. ..... 399/68
6,895,205 B2 * 5/2005 Nakamura et al. ..... 399/328
6,957,885 B2 * 10/2005 Noguchi et al. ..... 347/101
2002/0009315 A1 * 1/2002 Tomita ..... 399/323
2003/0129517 A1 * 7/2003 Hotta et al. ..... 430/108.22
2005/0244735 A1 * 11/2005 Ogata et al. ..... 430/108.8

FOREIGN PATENT DOCUMENTS

JP 2000081809 A * 3/2000
JP 2001305780 A * 11/2001
JP 2003-098884 A 4/2003
JP 2004053618 A * 2/2004

* cited by examiner

*Primary Examiner*—Robert Beatty
(74) *Attorney, Agent, or Firm*—Akin Gump Strauss Hauer & Feld LLP

(57) ABSTRACT

A fixing device includes a fixing member, a heat source for heating the fixing member, a pressure member urged against the fixing member so as to form a nip portion between the pressure member and the fixing member, and a release agent applying unit that applies a release agent to the fixing member or the pressure member. An amount A (weight parts) of wax contained in the toner, and an amount B (mg/sheet) of a release agent applied to the fixing member or the pressure member by the release agent applying unit per printing medium of A4 size satisfy the following relationships (1) through (3):

$$0 \leqq A \leqq 20 \quad (1)$$

$$0 \leqq B \leqq 1.0 \quad (2)$$

$$8 \leqq A+(12 \times B) \leqq 32. \quad (3)$$

12 Claims, 17 Drawing Sheets

FIXING DEVICE HAVING RELEASE AGENT APPLYING UNIT AND IMAGE FORMING APPARATUS

BACKGROUND OF THE INVENTION

This invention relates to a fixing device and an image forming apparatus using the fixing device.

A fixing device is used in an image forming apparatus such as a printer, a facsimile or the like. The fixing device applies heat and pressure to a printing medium to which a toner image has been transferred, so that the toner image is fixed to the printing medium. A type of fixing device (i.e., a heat roller type) has a heat roller, and another type of fixing device (i.e., a belt type) has a heat transferring belt. In these fixing devices, a release agent is applied to the surface of the heat roller or the heat transferring belt, in order to prevent the toner from sticking to the surface of the heat roller or the heat transferring belt. An example of the fixing device is discloses in, for example, Japanese Laid-Open Patent Publication NO. 2003-98884 (particularly, Page 3 and FIG. 1).

Recently, the image forming apparatus is required to be adaptable to a borderless printing, i.e., a printing without leaving a blank margin on the perimeter of the printing medium. However, if the margin on the leading edge of the printing medium in the feeding direction of the printing medium is small, there is a possibility that the printing medium may not separate from the heat roller or the like and may be wound around the heat roller or the like. Thus, a sufficient margin needs to be left on the leading edge of the printing medium, and therefore the borderless printing is not enabled. Further, in order to easily separate the printing medium from the heat roller, it is necessary to apply a large amount of release agent to the heat roller. However, in such a case, a large amount of release agent may adhere to the surface of the printing medium, with the result that the printing quality may be degraded.

SUMMARY OF THE INVENTION

An object of the present invention is to provide a fixing device and an image forming apparatus adaptable to borderless printing without causing the degradation of the printing quality.

The present invention provides fixing device including a fixing member, a heat source for heating the fixing member, a pressure member urged against the fixing member so as to form a nip portion between the pressure member and the fixing member, and a release agent applying unit that applies a release agent to the fixing member or the pressure member. The fixing member and the pressure member heat and press a printing medium that bears a toner image at the nip portion so as to fix the toner image to the printing medium. An amount A (weight parts) of a wax contained in the toner, and an amount B (mg/sheet) of a release agent applied to the fixing member or the pressure member by the release agent applying unit per printing medium of A4 size satisfy the following relationships (1) through (3):

$$0 \leqq A \leqq 20 \quad (1)$$

$$0 \leqq B \leqq 1.0 \quad (2)$$

$$8 \leqq A+(12 \times B) \leqq 32 \quad (3)$$

With such an arrangement, the releasability of the printing medium from the fixing member can be enhanced, and therefore it becomes possible to prevent the printing medium from being wound around the fixing member. Thus, it becomes possible to eliminate the blank margin on the leading edge of the printing medium, and therefore it becomes possible to fix the borderless image.

DETAILED DESCRIPTION OF THE PREFERRED EMBODIMENT

Embodiments of the present invention will be described with reference to the attached drawings.

First Embodiment

Figure 1:
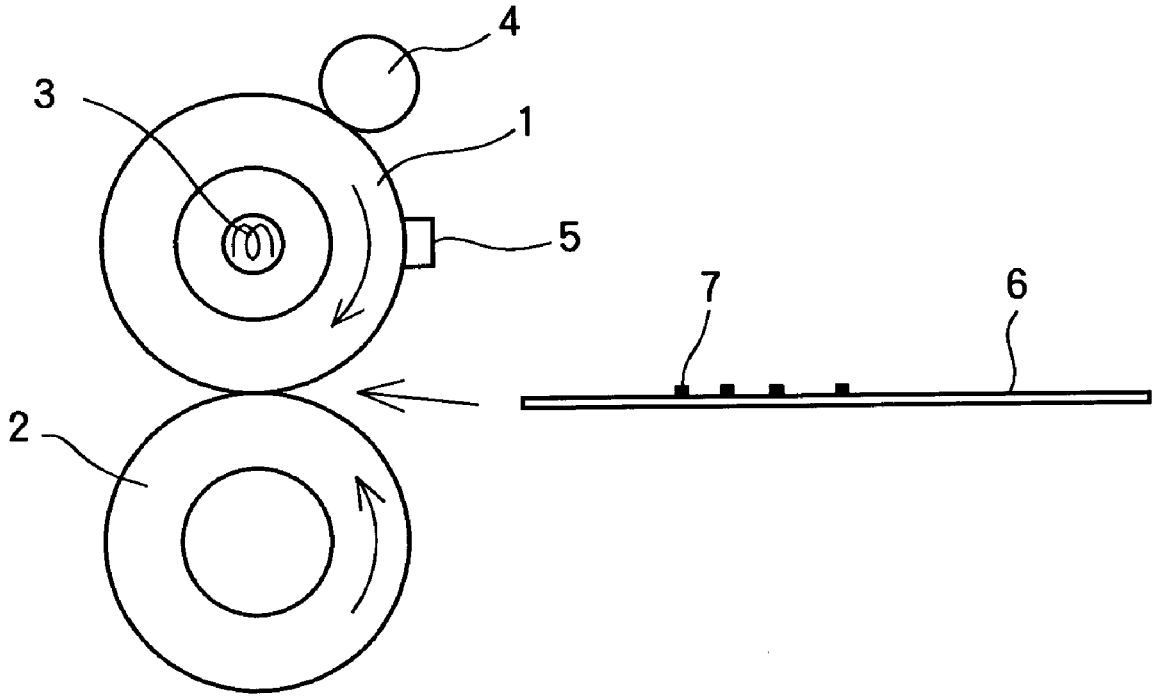
FIG. 1 is a side view showing the configuration of a fixing device according to the first embodiment of the present invention.
Figure 2A:
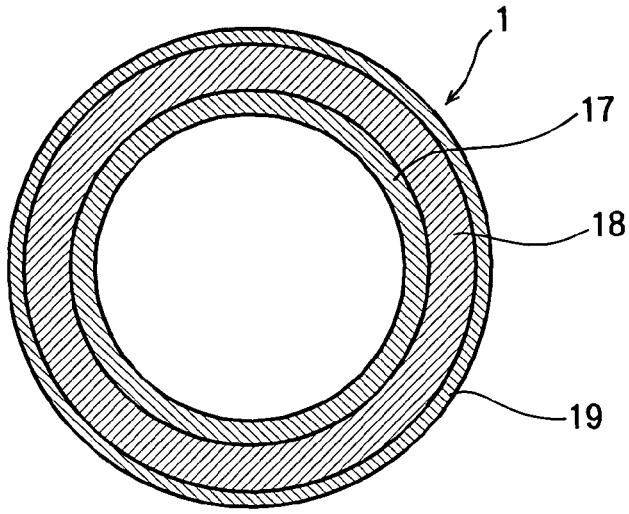
FIG. 2A is a sectional view showing an example of a fixing roller.

FIG. 1 shows the basic configuration of a fixing device according to the first embodiment of the present invention. The fixing device includes a fixing roller 1 and a pressure roller 2 disposed in parallel to each other. The fixing roller 1 is a so-called heat roller having an internal heat source 3. FIG. 2A is a sectional view showing the structure of the fixing roller 1, with the heat source 3 being omitted. The fixing roller 1 includes a core 17 in the form of a pipe, a resilient layer 18 formed on the core 17, and a release layer 19 covering the resilient layer 18. The core 17 is required to have a rigidity, and is made of a metal such as aluminum, iron, or stainless steel. The resilient layer 18 is made of rubber with excellent heat resistance such as general silicone rubber, sponge-like silicone rubber or fluoro-rubber. The release layer 19 is made of a material with excellent heat resistance and low surface free energy after the formation, such as a representative fluororesin (for example, polytetrafluorethylene (PTFE), perfluoro-alkoxyl-alkane (PFA), perfluoro-ethylene-propene-copolymer (FEP). The thickness of the release layer 19 is preferably from 10 μm to 50 μm.

Figure 2B:
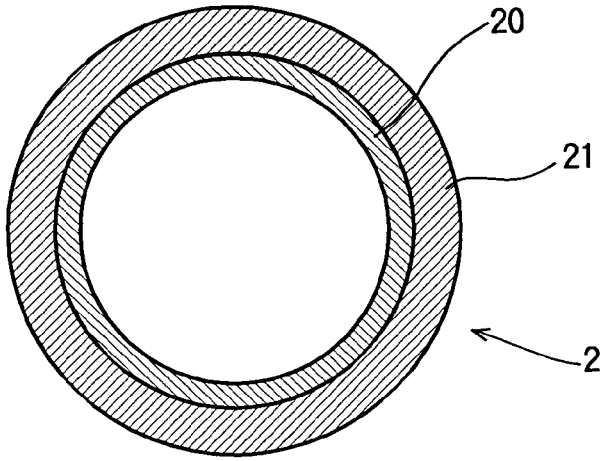
FIG. 2B is a sectional view showing an example of a pressure roller.

The pressure roller 2 is urged against the fixing roller 1 by means of a not shown urging mechanism, so that a nip portion is formed between the fixing roller 1 and the pressure roller 2. FIG. 2B is a sectional view showing the structure of the pressure roller 2. The pressure roller 2 includes a core 20 in the form of a pipe, and a resilient layer 21 formed on the core 20. As in the case of the fixing roller 1, the core 20 is made of a metal such as aluminum, iron or stainless steel. The resilient layer 21 is made of rubber with excellent heat resistance (for example, general silicone rubber, sponge-like silicone rubber or fluoro-rubber). If the double-sided printing is to be carried out, a release layer (as the release layer 21 shown in FIG. 2A) needs to be formed on the surface of the resilient layer 21 of the pressure roller 2.

As shown in FIG. 1, a release agent applying member 4 contacts the surface of the fixing roller 1. The release agent applying member 4 is made of an application roller or felt impregnated with a release agent. Further, the release agent applying member 4 can be made of a spray for spraying the release agent (made into mist) to the fixing roller 1. As the release agent, it is possible to use a material with excellent heat resistance, releasing property and chemical stability. For example, the release agent can be made of dimethyl-silicone oil, modified dimethyl-silicone oil (i.e., dimethyl-silicone oil with organic group contained) or fluorine oil.

A temperature sensor 5 contacts the surface of the fixing roller 1. The temperature sensor 5 detects the surface temperature of the fixing roller 1, and sends the detection signal to a not shown control unit.

As a binder resin used in the toner, it is possible to use polymer of styrene or its substitution (for example, polystyrene, poly-p-chlorostyrene or polyvinyl toluene). Further, as the binder resin, it is also possible use styrene copolymer (for example, styrene/p-chlorostyrene copolymer, styrene/propyrene copolymer, styrene/vinyl toluene copolymer, styrene/vinyl naphthalene copolymer, styrene/methyl acrylate copolymer, styrene/ethyl acrylate copolymer, styrene/buthyl acrylate copolymer, styrene/octhyl acrylate copolymer, styrene/methyl methacrylate copolymer, styrene/ethyl methacrylate copolymer, styrene/butyl methacrylate copolymer, styrene/methyl α-chlor-methacrylate copolymer, styrene/acrylonitrile copolymer, styrene/vinyl methyl ketone copolymer, styrene/butadiene copolymer, styrene/isoprene copolymer or styrene/maleic acid copolymer). Furthermore, as the binder resin, it is also possible to use acrylic ester polymer or copolymer thereof (for example, poly methyl acrylate, poly butyl acrylate, poly methyl methacrylate or poly butyl methacrylate). Additionally, as the binder resin, it is also possible to use polyvinyl derivative (for example, polyvinyl chloride or polyvinyl acetate), polyester copolymer, polyurethane copolymer, polyamide copolymer, polyimide copolymer, polyol copolymer, epoxy copolymer, or terpen copolymer. Moreover, as the binder resin, it is also possible to use aliphatic or alicyclic hydrocarbon, aliphatic petroleum resin or the like. The above described materials can be used individually, or two or more of the materials can be used in combination with each other. In terms of binding properties or electric properties, it is preferable that the toner includes at least one of the styrene-acryl copolymer, polyester resin and polyol resin.

There is a case where the toner contains a wax for preventing an offset when the toner is fixed to the printing medium. In such a case, it is possible to use polyethylene wax, propylene wax, carnauba wax or various ester wax. The melting point of the wax is preferably from 50 to 140° C. If the melting point of the wax is higher than 140° C., the wax may separate (or leak out) from the surface of the toner. If the melting point of the wax is lower than 50° C., it is difficult to sufficiently prevent the offset. The melting point of the wax is preferably from 60 to 130° C., and more preferably from 70 to 120° C.

As the coloring agent, it is possible to use pigment or dye generally used as a coloring agent in the toner. For example, it is possible to use carbon black, lamp black, iron black, ultramarine blue pigment, nigrosine dye, pigment yellow, pigment red, pigment blue, aniline blue, phthalocyanine blue, phthalocyanine green, Hansa yellow G, rhodamine lake 6C, calco oil blue, chrome yellow, quinacridon red, benzidine yellow or rose Bengal. These materials can be used individually, or two or more of the materials can be used in combination with each other.

It is possible that the toner contains a general charge control agent for enhancing the initial rise of the electric charge. In particular, it is possible to use charge control agent of a positively charging type or a negatively charging type. As the charge control agent of the positively charging type, it is possible to use vinyl copolymer including amino group, quaternary ammonium salt compound, nigrosine pigment, polyamine resin, imidazole compound, agine pigment, triphenylmethane, guanidine compound or lake pigment). As the charge control agent of the negatively charging type, it is possible to use carboxylic acid derivative or metal salt thereof, alcoxylate, organic metal complex, or chelate compound. These materials can be used individually, or two or more of the materials can be used in combination with each other. If the charge control agent of the negatively charging type is to be used, it is preferable to add metal salt of salicylic acid derivative as an additive for obtaining a stability in initial rise of the electric charge.

In order to enhance the fluidity or environment dependency of the toner, it is possible to add an additive to the toner, such as inorganic powders (for example, silica, zinc oxide, tin oxide, aluminum oxide, titanium oxide, silicon oxide, strontium titanate, barium titanate, calcium titanate, strontium zirconate, calcium zirconate, lanthanum titanate, calcium carbonate, magnesium carbonate, mica or dolomite) or hydrophobic material thereof. These additives can be used individually, or two or more of the additives can be combined with each other. As a surface modification additive of the toner, it is possible to use fine particles of fluoro resin (for example, polytetrafluorethylene, tetrafluorethylene/hexafluoropropylene copolymer, or polyvinylidene fluoride) By adding these additives (of approximately 0.1 to 10 weight parts) to mother particle of the toner (of 100 weight parts), and mixing the additives and the mother particles using a suitable mixing machine at needs, it is possible to adjust the additives so that the additives adhere to the surfaces of the toner particles, or the additives float between the toner particles.

Figure 2C:
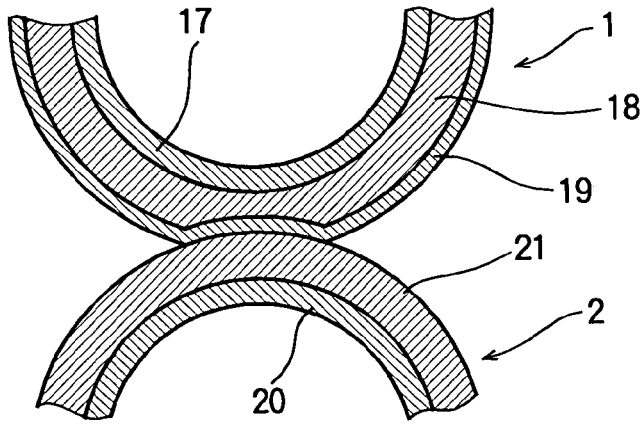
FIG. 2C is a sectional view showing an example of a nip portion between the fixing roller and the pressure roller.

The operation of the fixing device shown in FIG. 1 will be described. The pressure roller 2 is urged against the fixing roller 1 so that the nip portion is formed between the fixing roller 1 and the pressure roller 2 as was described above. The control unit (not shown) controls the heat source 3 based on the temperature detection signal sent from the temperature sensor 5, so as to keep the surface temperature of the fixing roller 1 within a suitable range. The release agent applying member 4 applies the release agent to the surface (i.e., the release layer 19) of the fixing roller 1. The release agent is held in concaves on the surface of the release layer 19 having a predetermined surface roughness. FIG. 2C is an enlarged sectional view of the nip portion between the fixing roller 1 and the pressure roller 2. Since the pressure roller 2 is urged against the fixing roller 1, the resilient layer 18 of the fixing roller 1 deforms to be indented in the vicinity of the nip portion.

The toner (denoted by numeral 7 in FIG. 1) is transferred to the surface of the printing medium 6 (for example, a copy paper of A4 size) by means of a not shown transferring portion. The printing medium 6 that bears the unfixed toner is carried through the nip portion between the fixing roller 1 and the pressure roller 2 and is heated and pressed so that the toner 7 is fixed to the printing medium 6. The printing medium 6 separates from the surface of the fixing roller 1 without being wound around the fixing roller 1. The separation of the printing medium 6 from the fixing roller 1 (without being wound around the fixing roller 1) is caused by a multiplier effect of the following reasons (1) to (4):

(1) the radius of curvature at the exit end of the nip portion in the feeding direction is small, compared with the radius of the fixing roller 1, (2) the release layer 19 of the fixing roller 1 has a high releasability, (3) the release agent applying member 4 applies the release agent to the surface of the release layer 19, and (4) the toner 7 contains the wax.

Figure 3A:
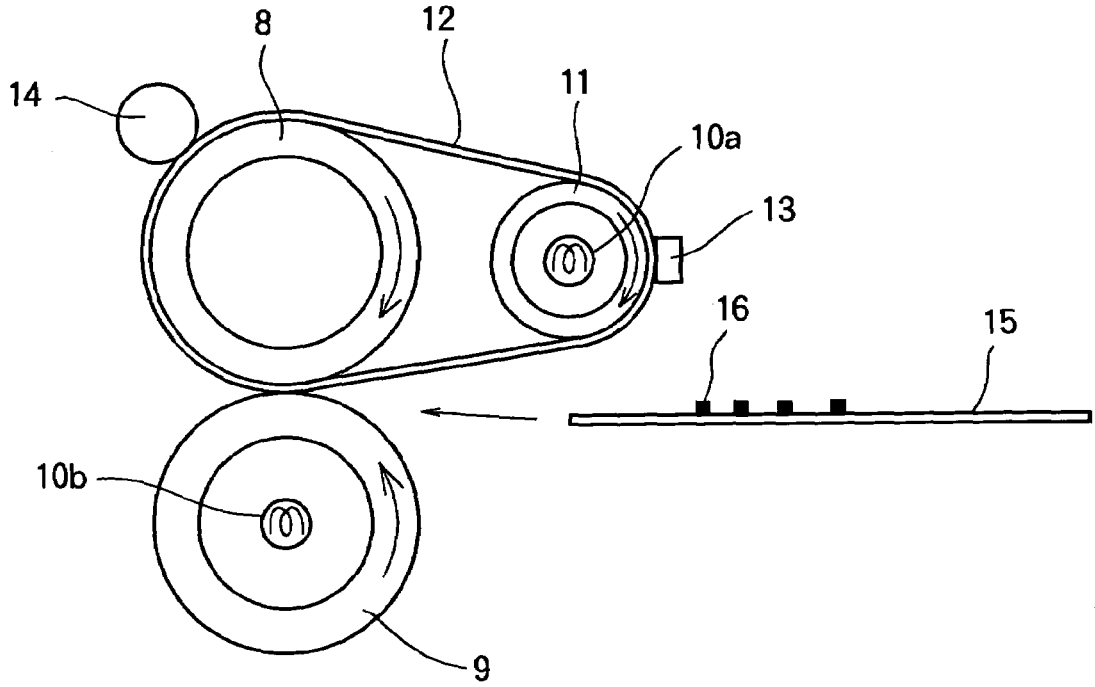
FIG. 3A is a side view showing another example of the fixing device according to the first embodiment of the present invention.

Next, the fixing device using the belt will be described. FIG. 3A shows the basic configuration of an example of the fixing device using the belt. The fixing device includes a fixing roller 8, a heat roller 11 and a fixing belt 12 stretched around the fixing roller 8 and the heat roller 11. The heat roller 11 has an internal heat source 10*a*. A pressure roller 9 is urged against the fixing roller 8 via the fixing belt 12. The pressure roller 9 has an internal heat source 10*b*. A temperature sensor 13 contacts the surface of the fixing belt 12 to detect the surface temperature of the fixing belt 12. A release agent applying member 14 contacts the surface of the fixing belt 12 to apply the release agent to the fixing belt 12.

Each of the fixing roller 8 and the pressure roller 9 includes a core 20 (FIG. 2B) in the form of a pipe, a resilient layer 21 (FIG. 2B) formed on the core 20, as in the case of the pressure roller 2 (FIG. 2B). The core 20 is made of a metal such as aluminum, iron or stainless steel. The resilient layer 21 is made of rubber with excellent heat resistance (for example, general silicone rubber, sponge-like silicone rubber or fluoro-rubber). The heat roller 11 with the heat source 10*a* is composed of a pipe made of metal (for example, aluminum, iron or stainless steel).

Figure 3B:
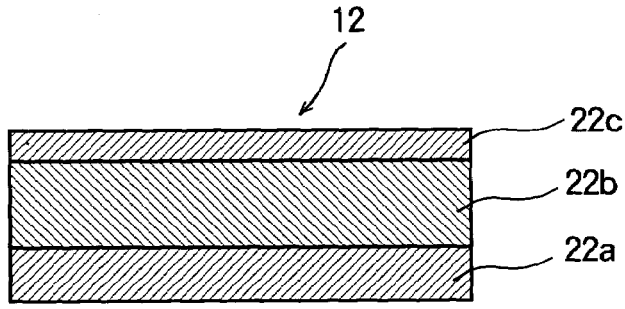
FIG. 3B is an enlarged sectional view showing an example of a fixing belt of the fixing device shown in FIG. 3A.
Figure 3C:
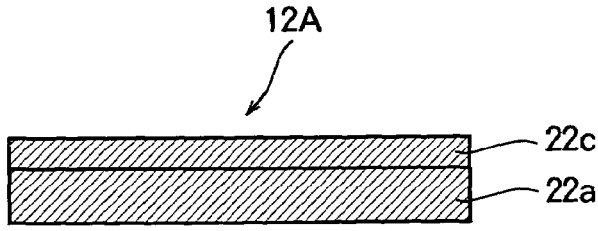
FIG. 3C is an enlarged sectional view showing another example of the fixing belt of the fixing device shown in FIG. 3A.

FIGS. 3B and 3C are enlarged sectional views of examples of the fixing belt 12. As shown in FIG. 3B, the fixing belt 12 includes a thin substrate 22*a*, a resilient layer 22*b* (made of silicone rubber, fluoro resin or the like) formed on the substrate 22*a*, and a release layer 22*c* formed on the resilient layer 22*b*. If the substrate 22*a* is made of nickel, polyimide, stainless steel or the like, the thickness of the substrate 22*a* is preferably from 30 μm to 150 μm. If the resilient layer 22*b* is made of silicone rubber, the thickness of the resilient layer 22*b* is preferably from 50 μm to 300 μm. If the resilient layer 22*b* is made of fluoro resin, the thickness of the resilient layer 22*b* is preferably from 10 μm to 50 μm. Further, as shown in FIG. 3C, the fixing belt 12 can be composed of a thin substrate 22*a* and a release layer 22*c* formed on the thin substrate 22*a*. In each of the structures shown in FIGS. 3B and 3C, the fixing belt 12 is stretched around the fixing roller 8 and the heat roller 11 in such a manner that the release layer 22*c* is on the outer side of the fixing belt 12.

As is the case with the release layer 19 shown in FIG. 2A, the release layer 22*c* of the fixing belt 12 is made of a material with excellent heat resistance and low surface free energy, such as a representative fluororesin (for example, polytetrafluorethylene (PTFE), perfluoro-alkoxyl-alkane (PFA) or perfluoro-ethylene-propene-copolymer (FEP). The thickness of the release layer 22*c* is preferably from 10 μm to 50 μm. The surface of the release layer 22*c* of the fixing belt 12 has a predetermined surface roughness for holding the release agent applied by the release agent applying member 14.

The release agent applying member 14, the temperature sensor 13, the toner 16 and the printing medium 15 are the same as the release agent applying member 4, the temperature sensor 5, the toner 7 and the printing medium 6 described with reference to FIG. 1.

The operation of the fixing device shown in FIG. 3 will be described. The pressure roller 9 is urged against the fixing roller 8 via the fixing belt 12, so that a nip portion is formed between the fixing belt 12 and the pressure roller 9. The control unit (not shown) controls the heat sources 10*a* and 10*b* based on the temperature detecting signal sent from the temperature sensor 13, so as to keep the surface temperature of the fixing belt 12 within a suitable range. The release agent applying member 14 applies the release agent to the surface (i.e., the release layer 22*c*) of the fixing belt 12. The release agent is held in concaves formed on the surface of the fixing belt 12 having the predetermined surface roughness. The toner is transferred to the surface of the printing medium 15 by means of a not shown transferring portion. The printing medium 15 is carried through the nip portion between the fixing belt 12 and the pressure roller 9 and is heated and pressed so that the toner 16 is fixed to the printing medium 15. The printing medium 15 separates from the surface of the fixing belt 12 without being wound around the fixing belt 12.

Next, the experiment with respective parameters for determining the condition enabling a fixing of a borderless image will be described. The experiment is conducted on the relationship between content of the wax in the toner and an adhesive force between the printing medium and the fixing roller 1, i.e., a force necessary to separate the printing medium from the fixing roller 1 (also referred to as a separation resistance force). The experiment is also conducted on the relationship between a margin necessary to separate the printing medium from the fixing roller 1 or the like (i.e., a necessary margin) and the adhesive force. The experiment is also conducted on the contribution of a surface roughness of the fixing roller 1 and an amount of the applied release agent, to the adhesive force and the necessary margin.

Figure 4:
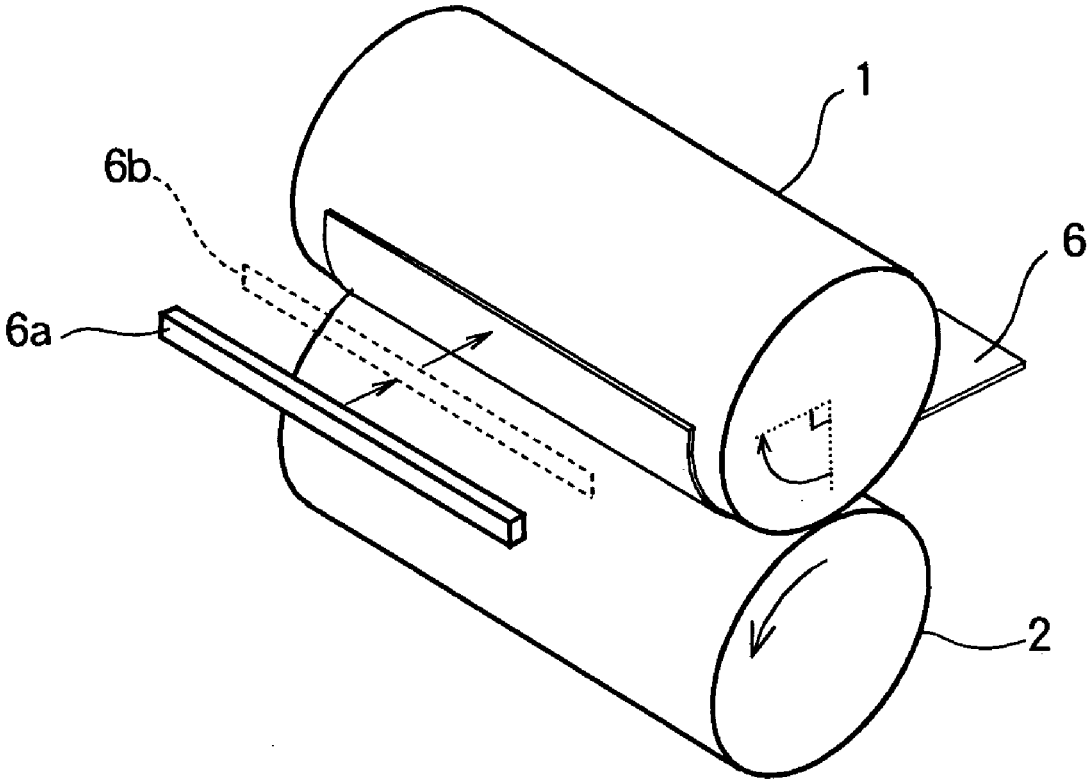
FIG. 4 is a schematic view showing a measuring method of an adhesive force.

FIG. 4 is a schematic view illustrating a measuring method of the adhesive force. The printing medium 6 (i.e., a sheet of A4 size) is fed in the width direction thereof through the nip portion between the fixing roller 1 and the pressure roller 2, and is intentionally wound around the fixing roller 1. When the leading edge of the printing medium 6 reaches a position corresponding to the rotation of the fixing roller 1 by 90 degrees from the nip portion, the operation of the fixing device is stopped. In this state, a plate-shaped holder **6*a* having the length of 297 mm (same as the length of the printing medium 6) and the width of 5 mm is attached to the leading edge of the printing medium 6 by means of the double sided adhesive tape 6*b* having the length of 297 mm and the width of 5 mm. Then, the center of the holder 6*a* in the longitudinal direction thereof is pulled in the direction perpendicular to the surface of the holder 6*a* (i.e., in the direction in which the printing medium 6 is peeled off from the fixing roller 1) using a tension gauge in such a manner that the tension increases at the rate of 100 gf/s (=0.98 N/s). When the printing medium 6 is peeled off from the surface of the fixing roller 1**, the tension is read. The measurement result may be influenced by a fixing temperature, a feeding speed of the printing medium, and the speed of the tensioning of the tension gauge. However, when the experiment is repeated 10 times under the same conditions, the variation of the experimental results is within ±8% with respect to the average. Thus, it is understood that the experimental result has a sufficient repeatability. Each data of the adhesive force in the following graphs is the average of 10 times.

The fixing roller 1 used in the experiment of measuring the adhesive force is composed of a core made of a pipe of aluminum with the diameter of 36 mm (and the thickness of 1.5 mm) and a release layer made of a tube of PFA having the thickness of 30 μm. No resilient layer is formed between the core and the release layer. The surface roughness Rz of the release layer is 0.2 μm. The Asker C hardness of the surface of the fixing roller 1 is 95 degrees. The pressure roller 2 is composed of a core made of a pipe of aluminum with the diameter of 36 mm (and the thickness of 1.5 mm), a resilient layer of silicone rubber (with the thickness of 2.0 mm) and a release layer made of a tube of PFA having the thickness of 30 μm. The surface roughness Rz of the release layer is 0.2 μm. The Asker C hardness of the surface of the pressure roller 2 is 70 degrees.

In the experiment, the force with which the pressure roller 2 is urged against the fixing roller 1 is 30 kgf (=294N). Emulsion polymerization toners of respective colors (yellow, magenta, cyan) are used. The content of the wax in the toner is from 0 to 40 weight parts. The printing medium has the size of A4 size, and the weight per unit area of 64 g/m$^2$. The amount of the toner transferred to one printing medium (i.e., one sheet) is 1.5±0.1 g/sheet. The feeding speed of the printing medium passing through the fixing roller 1 and the pressure roller 2 is 100 mm/s. The feeding direction of the printing medium is the width direction of the printing medium (i.e., a cross-feeding). The surface temperature of the fixing roller 1 is 160° C., and the surface temperature of the pressure roller 2 is 130° C. As the release agent, dimethyl silicone whose kinetic viscosity is 300 cSt (=300 cm$^2$/s) is used. The amount of the toner applied to the fixing roller 1 (per printing medium) is from 0 to 6 mg/sheet. The application of the release agent to the fixing roller 1 is carried out by using the application roller having a porous surface impregnated with the release agent. The application roller contacts the fixing roller 1 to applies the release agent to the fixing roller 1.

In the experiment, the printing medium whose weight is relatively light (64 g/m$^2$) is chosen among general printing media (copy sheets), in order to evaluate the adhesive force under a strict condition. The transferring amount of the toner is adjusted so that the density is at its maximum when the images of yellow, magenta and cyan are superimposed on the printing medium. The toner is uniformly transferred to the whole surface of the printing medium so that no margin is formed on the leading edge of the printing medium in the feeding direction, and a margin of 5 mm is formed on the trailing edge of the printing medium in the feeding direction. Although a slight offset occurs when the adhesive force is greater than or equals to 700 gf (=6.9 N), the measured value thereof is employed.

The toner is manufactured by emulsion polymerization as follows:

(1) As the binder resin of the toner, primary particles of polymer are formed in water solvent. In this example, primary particles composed of styrene/acryl copolymer is made from styrene, acrylate and methyl-methacrylate in the water solvent.

(2) Next, a coloring agent, which is emulsified by emulsifying agent (i.e., surface active agent), is added to the solvent in which the primary particles are formed. Further, if necessary, wax or charge controlling agent are added to the solvent. Pigment yellow 74 is used as the coloring agent of yellow. Pigment red 238 is used as the coloring agent of magenta. Pigment blue 15:3 is used as the coloring agent of cyan. Stearyl stearate (higher fatty acid ester wax) is used as the wax. In order to enhance the fluidity, silica whose particle diameter is from 8 to 20 μm is added by 1 to 3 weight parts.

(3) The resultant material is agglomerated in the solvent, with the result that the toner is formed in the solvent. The toner is taken out from the solvent, and cleaned and dried so that unnecessary solvent and by-product are removed. As a result, the toner particles are obtained.

Figure 5:
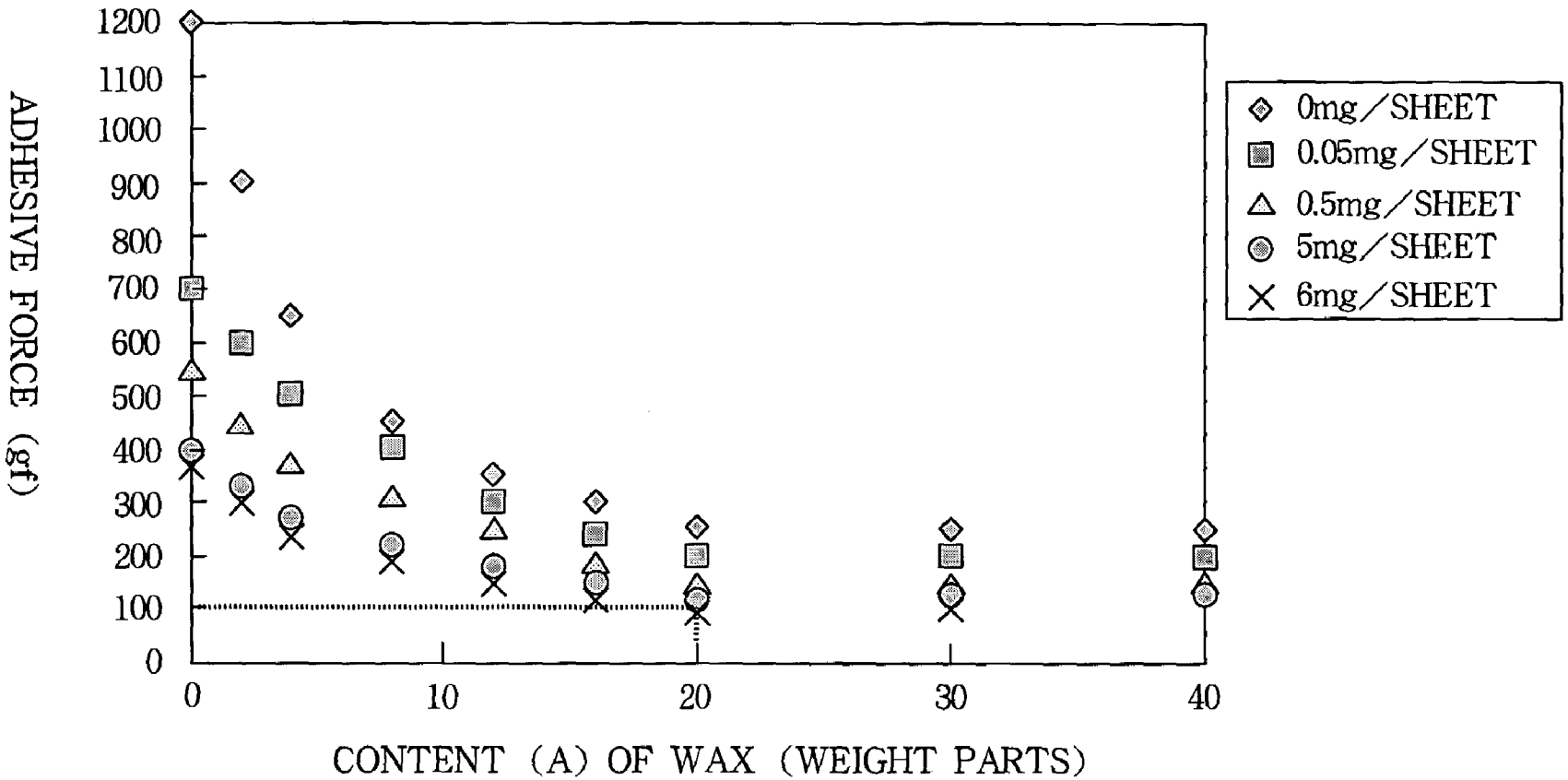
FIG. 5 is a graph showing the relationship between the adhesive force and the content of the wax in the toner, with the amount of applied release agent being varied.

The result of the measurement of the adhesive force (under the above described condition) will be described. FIG. 5 is a graph illustrating the relationship between the adhesive force and the content of the wax in the toner, with the amount of the applied toner being varied. The amount of the applied toner is evaluated by the weight of the toner applied to one printing medium of A4 size. This is calculated based on the change in weight of the release agent applying member 4 after 1000 printing media (1000 sheets) have passed the nip portion between the fixing roller 1 and the pressure roller 2. In this experiment, the amount of the applied toner is varied in 5 ways, i.e., 0 mg/sheet, 0.05 mg/sheet, 0.5 mg/sheet, 5.0 mg/sheet and 6.0 mg/sheet.

Based on FIG. 5, it is understood that the adhesive force decreases as the content of the wax increases from 0 to 20 weight parts, but has leveled off when the content of the wax is higher than or equals to 20 weight parts, in each of the cases where the amount of the applied release agent is 0, 0.05, 0.5, 5.0 and 6.0 mg/sheet. Therefore, in order to obtain the effect of reducing the adhesive force, it is sufficient that the toner contains 20 weight parts of the wax at a maximum. Thus, the preferable range of the content (weight parts) A of the wax in the toner is $0 \leqq A \leqq 20$. In order to prevent the agglomeration of the toner (when the toner is left for a long time) and a filming phenomena in the developing device, it is preferable that the content of the toner is as low as possible. However, since the agglomeration and filming phenomena can be prevented by enhancing the sealing method or the developing process, the above described range of the content A of the wax in the toner is not further reduced.

Further, as shown in FIG. 5, the adhesive force is 100 gf (0.98 N) when the amount of the applied toner is 5 mg/sheet and 6 mg/sheet. Thus, it is understood that, even if the amount of the applied toner further increases, the adhesive force is kept constant at 100 gf (0.98 N). Accordingly, it is understood that the lower limit of the adhesive force is 100 gf (0.98 N). Further, since it is preferable that the amount of the release agent is as small as possible (for reducing the possibility that the release agent adheres to the printing medium), the substantial maximum amount of the releasing agent is 5.0 mg/sheet.

Figure 6A:
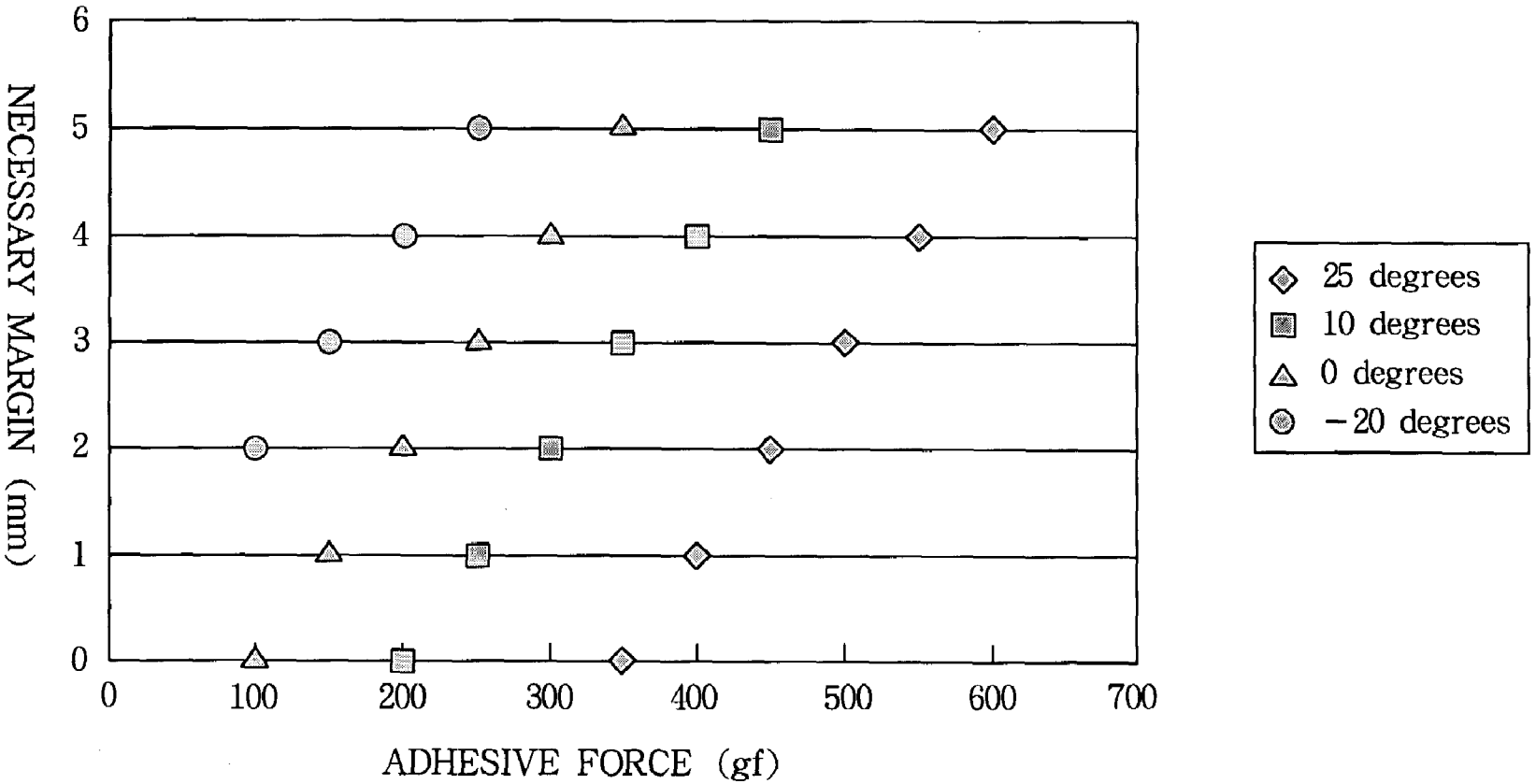
FIG. 6A is a graph showing the relationship between the adhesive force and the margin necessary to separate the leading edge of the printing medium from the fixing roller, with the difference in hardness between the fixing roller and the pressure roller being varied.

FIG. 6A is a graph illustrating the relationship between the necessary margin for separating the leading edge of the printing medium from the surface of the fixing roller 1 and the adhesive force, with the difference of the hardness of the fixing roller 1 and the pressure roller 2 being varied. In FIG. 6A, the hardness difference (i.e., the subtraction of the Asker C hardness of the fixing roller 1 from the Asker C hardness of the pressure roller 2) is varied in 4 ways, i.e., 25 degrees, 10 degrees, 0 degree and −20 degrees. In this experiment, the margin is formed at the leading edge of the printing medium, and the margin at the trailing edge of the printing medium is set to be small, so as to keep the transferring area constant. As shown in FIG. 6A, the necessary margin of the printing medium is the margin (i.e., the width between the leading edge of the printing medium and the printing area on the printing medium) when the printing medium passes the nip portion between the fixing roller 1 and the pressure roller 2 five times and successfully separate from the fixing roller 1 five times.

The fixing roller 1 used in the experiment is composed of a core made of a pipe of aluminum having the diameter of 36 mm (and the thickness of 1.5 mm), a resilient layer made of silicone rubber (having the thickness of 2.0 mm) formed on the core and a release layer made of a tube of PFA (having the thickness of 30 μm) formed on the resilient layer. The surface roughness Rz of the release layer is 0.2 μm. The Asker C hardness of the surface of the fixing roller 1 is 70 degrees. The pressure roller 2 is composed of a core made of a pipe of aluminum having the diameter of 36 mm (and the thickness of 1.5 mm), a resilient layer made of silicone rubber (having the thickness of 0 to 2.0 mm) formed on the core and a release layer made of a tube of PFA (having the thickness of 30 μm) formed on the resilient layer. The surface roughness Rz of the release layer is 0.2 μm. The surface roughness Rz of the release layer is 0.2 μm. The thickness of the resilient layer is varied in three ways ranging from 0 μm to 2.0 μm so that the Asker C hardness is varied in three ways, i.e., 70 degrees, 80 degrees and 95 degrees. As the pressure roller 2, another kind of roller (whose Asker C hardness is lower than the fixing roller 1) is prepared, which is composed of a core made of a stainless shaft having the diameter of 36 mm and a resilient layer made of silicone rubber (having the thickness of 6.0 mm) formed on the core. The surface roughness Rz of the pressure roller 2 is 0.2 μm, and the Asker C hardness of the surface of the pressure roller 2 is 50 degrees.

The urging force with which the pressure roller 2 is urged against the fixing roller 1 is 30 kgf. Emulsion polymerization toners of respective colors (yellow, magenta, cyan) are used. The content of the wax in the toner is varied in the range from 0 to 20 weight parts. The printing medium has the size of A4 size, and the weight per unit area of 64 g/m$^2$. The amount of the toner transferred to one printing medium is 1.5±0.1 g/sheet. The feeding speed of the printing medium passing through the nip portion between the fixing roller 1 and the pressure roller 2 is 100 mm/s, and the feeding direction is the width direction of the printing medium. The surface temperature of the fixing roller 1 is 160° C., and the surface temperature of the pressure roller 2 is 130° C. As the release agent, dimethyl-silicone is used with the kinetic viscosity of 300 cSt. The amount of the release agent applied to one printing medium is from 0 to 6 mg/sheet. The release agent is applied to the fixing roller 1 by urging the application roller having the porous surface layer impregnated with the release agent against the surface of the fixing roller 1.

The reason why the resilient layer (of silicone rubber) of the fixing roller 1 is 2 mm is as follows. As the thickness of the resilient layer increases, the heat resistance and the heat capacity may also increase, and therefore the delay in temperature increase (for example, overshoot or undershoot) may occur, so that it may be difficult to control the temperature. Such problem does not occur when the thickness of the resilient layer of the fixing roller 1 is less than or equals to 2 mm.

Based on FIG. 6A, it is understood that the necessary margin of the printing medium becomes large as the adhesive force increases. In other words, as the adhesive force increases, the printing medium does not separate from the fixing roller 1 unless a large margin is provided. Further, as the harness difference (i.e., the subtraction of the Asker C hardness of the fixing roller 1 from the Asker C hardness of the pressure roller 2) becomes large, the necessary margin becomes small even when the adhesive force is large.

When the hardness difference (i.e., the subtraction of the Asker C hardness of the fixing roller 1 from the Asker C hardness of the pressure roller 2) is −20 degrees, the margin of 2 mm is needed even when the adhesive force is 100 gf (minimum). Thus, it may be considered that the condition with the hardness difference of −20 degrees is unsuitable for the borderless printing. However, the borderless printing is not limited to the printing operation that leaves completely no blank margin at the perimeter of the printing medium. In some cases, the printing operation that leaves the blank margin less than 2 mm on the leading edge (in the feeding direction) of the printing medium is also called as the borderless printing. In such a case, it is possible to accomplish the object even when the hardness difference is −20 degrees.

Further, if the release layer is directly formed on the pipe of aluminum without the resilient layer, the Asker C hardness is approximately 95 degrees, and a hardness greater than 95 degrees is of no practical use. Thus, the Asker C hardness C of the fixing roller 1 is preferably in the range of: $70 \leqq C \leqq 95$. The hardness difference (D−C), i.e., the subtraction of the Asker C hardness C (degrees) of the fixing roller 1 from the Asker C hardness D (degrees) of the pressure roller 2 is preferably in the range of: $-20 \leqq D-C \leqq 25$.

Based on FIG. 6A, when the above described hardness difference is in the range from −20 to 25 degrees, the adhesive force needs to be in the range from 100 gf (0.98 N) to 450 gf (4.41 N) in order to keep the blank margin less than or equals to 2 mm.

Figure 6B:
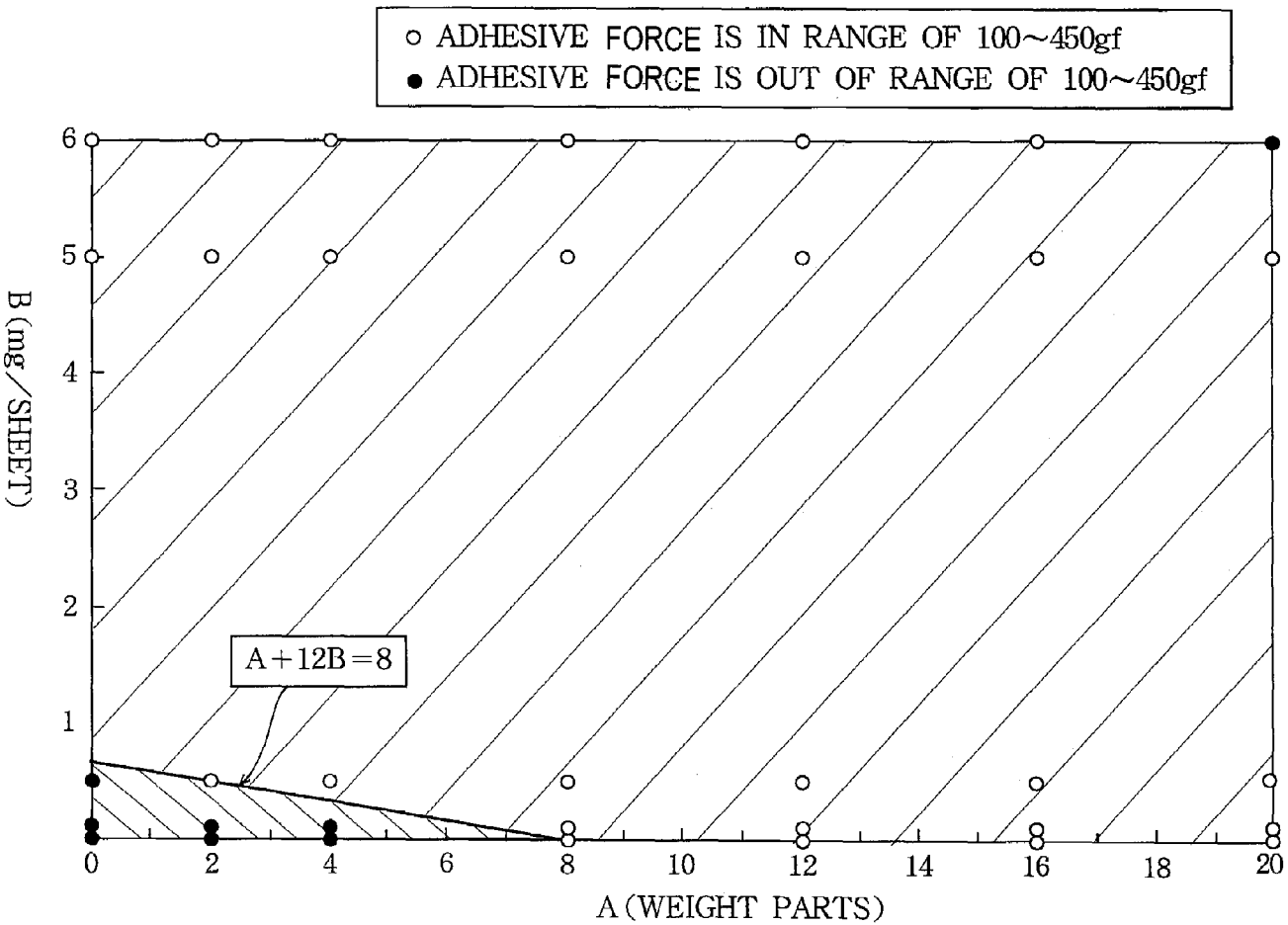
FIG. 6B is a graph showing the relationship between the content of the wax in the toner and the necessary margin.

FIG. 6B shows the relationship between the content A of the wax in the toner and the amount B of the release agent applied to the fixing roller 1 when the adhesive force is in the range from 100 gf to 450 gf. In FIG. 6B, a lower bound of the area (in which the adhesive force is in the range from 100 gf to 450 gf) is expressed as $A+(12\times B)=8$.

Further, as was described with reference to FIG. 5, the maximum amount (B) of the release agent applied to the fixing roller 1 is 5 mg/sheet. Considering of the maximum content A of the wax (20 weight parts) and the maximum amount B of the releasing agent (5 mg/sheet), the maximum value of $A+(12\times B)$ is 80.

Therefore, based on FIG. 6B, in order to keep the adhesive force from 100 gf to 450 gf, the content A (weight parts) of the wax in the toner and the amount B (mg/s) of the release agent applied to the release layer of the fixing roller 1 per printing medium need to satisfy the following relationship:

$$8 \leqq A+(12\times B) \leqq 80$$

Figure 7A:
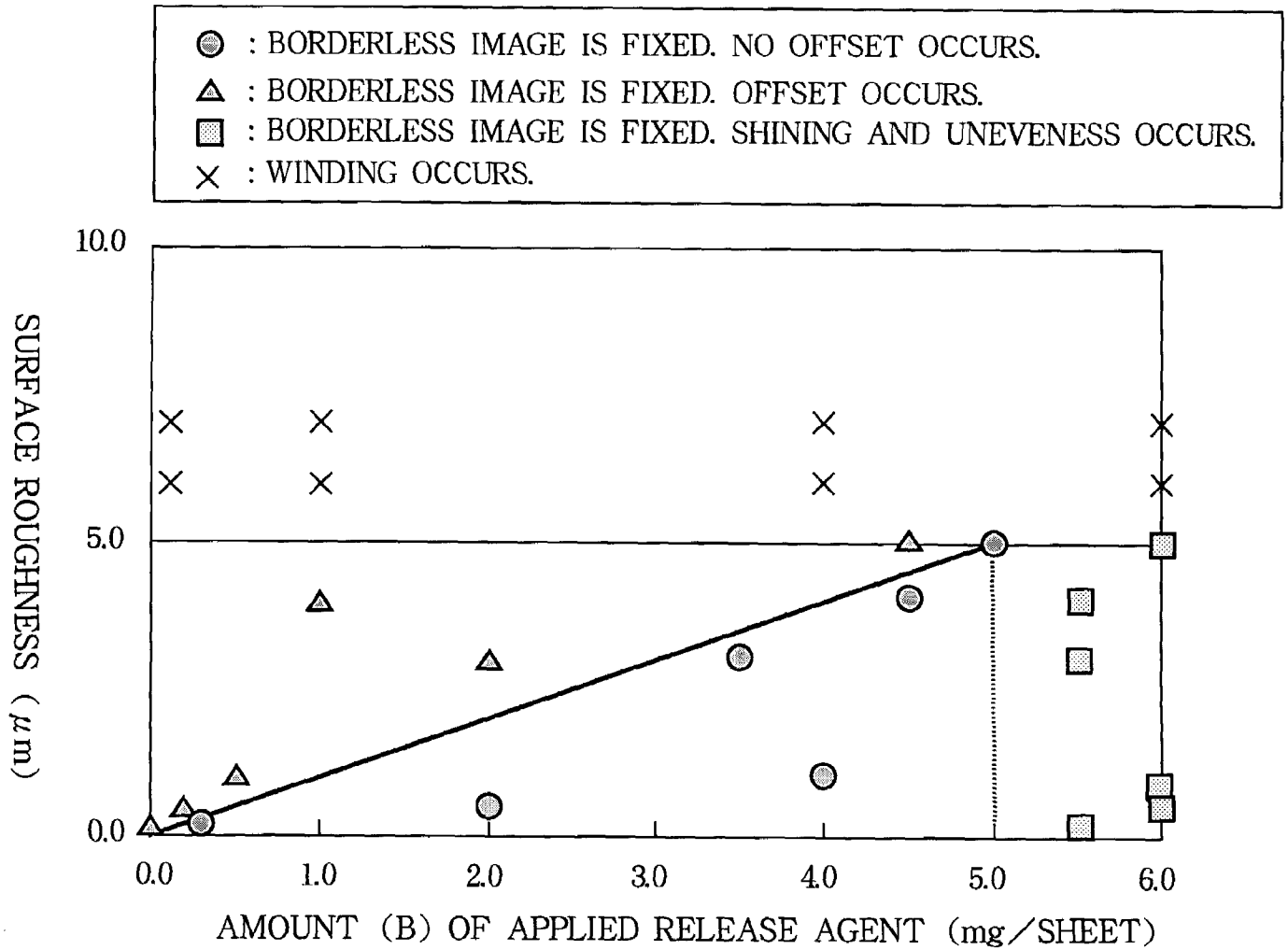
FIG. 7A is a graph showing the change of the fixing properties with respect to the surface roughness of a release layer of the fixing roller and the amount of applied release agent.

FIG. 7A is a graph illustrating the change in fixing properties with respect to the surface roughness of the release layer of the fixing roller 1 and the amount of the applied release agent. The fixing roller 1 used in this measurement is composed of a core made of a pipe of aluminum having the diameter of 36 mm (and the thickness of 1.5 mm), a resilient layer made of silicone rubber (having the thickness of 2.0 mm) formed on the core and a release layer made of a tube of PFA (having the thickness of 30 μm) formed on the resilient layer. The surface roughness Rz of the release layer is from 0.2 to 0.7 μm. The Asker C hardness of the surface of the fixing roller 1 is 70 degrees. The pressure roller 2 is composed of a core made of a pipe of aluminum having the diameter of 36 mm (and the thickness of 1.5 mm) and a release layer made of a tube of PFA (having the thickness of 30 μm) formed on the pipe of aluminum without providing the resilient layer. The surface roughness Rz of the release layer is 0.2 μm. The Asker C hardness of the surface of the pressure roller 1 is 95 degrees.

The urging force with which the pressure roller 2 is urged against the fixing roller 1 is 30 kgf. The emulsion polymerization toners of respective colors (yellow, magenta, cyan) are used. The content of the wax in the toner is 8 weight parts. The printing medium has the size of A4 size, and the weight per unit area of 64 g/m$^2$. The amount of the toner transferred to one printing medium is 1.5±0.1 g/sheet. The toner is transferred to the printing medium so that a margin of approximately 2.0 mm is formed on the leading edge of the printing medium in the feeding direction. The feeding speed of the printing medium passing through the nip portion between the fixing roller 1 and the pressure roller 2 is 100 mm/s, and the feeding direction is the width direction of the printing medium. The surface temperature of the fixing roller 1 is 160° C., and the surface temperature of the pressure roller 2 is 130° C. As the release agent, dimethylsilicone is used with the kinetic viscosity of 300 cSt. The amount of the release agent applied to one printing medium is from 0 to 6 mg/sheet. The release agent is applied to the fixing roller 1 by urging the application roller having the porous surface layer impregnated with the release agent against the surface of the fixing roller 1.

The reason why the Asker C hardness of the fixing roller 1 and the pressure roller 2 are respectively 70 degrees and 95 degrees is to keep the adhesive force (100 to 450 gf) at its maximum (450 gf). Further, the reason why the content of the wax in the toner is 8 weight parts is to keep the adhesive force at its maximum even when the amount of the applied release agent is 0 mg/sheet. The release layer of the fixing roller 1 is composed of a tube of PFA uniformly ground by means of lapping sheet and sintered for 3 hours at 350° C.

Under the above described condition, the printing operation is carried out. Whether a borderless image (i.e., an image transferred to the printing medium so that a margin of 2 mm or less is left on the leading edge of the printing medium) is fixed or not is checked. Further, whether the poor fixing (i.e., an offset, a shining or an unevenness) occurs or not is checked. The experimental result is shown in FIG. 7A. Based on FIG. 7A, the condition with which the borderless image is printed and the poor fixing does not occur is that the surface roughness Rz of the release layer of the fixing roller 1 is less than or equals to 5.0 μm, the amount B of the release agent applied to the fixing roller 1 is less than or equals to 5.0 mg/sheet, and the Rz/B is less than or equals to 1.0.

By totally observing FIGS. 5 through 7A, the borderless image is fixed and the poor fixing does not occur when the content A (weight parts) of the wax in the toner, the amount B of the release agent applied to the fixing roller 1 (mg/sheet: per sheet of A4 size), the surface roughness Rz (μm) of fixing roller 1, the Asker C hardness C of the surface of the fixing roller 1, the Asker C hardness D of the surface of the pressure roller 2 satisfy the following relationships:

$$0 \leqq A \leqq 10 \quad \text{(a1)}$$

$$0 \leqq B \leqq 5.0 \quad \text{(a2)}$$

$$8 \leqq A+(12+B) \leqq 80 \quad \text{(a3)}$$

$$0 < Rz \leqq 5.0 \quad \text{(a4)}$$

$$0 < Rz/B \leqq 1.0 \quad \text{(a5)}$$

$$70 \leqq C \leqq 95 \quad \text{(a6)}$$

$$-20 \leqq D-C \leqq 25 \quad \text{(a7)}$$

The surface roughness Rz of the release layer of the fixing roller 1 exerts a large influence on the printing quality. If the surface roughness Rz of the release layer is greater than 1 μm, the printed surface becomes coarse, which is not suitable for an image preferred to be lustrous (for example, a photograph or a poster). Accordingly, it is preferred that the surface roughness of the fixing roller 1 is less than or equals to 1 μm. Thus, as shown in FIG. 7A, it is understood that the amount B of the applied release agent needs to be less than or equals to 1.0 mg/sheet, in order to enable the fixing of the borderless image and prevent the poor fixing even when the surface roughness Rz is less than or equals to 1.0 μm.

Figure 7B:
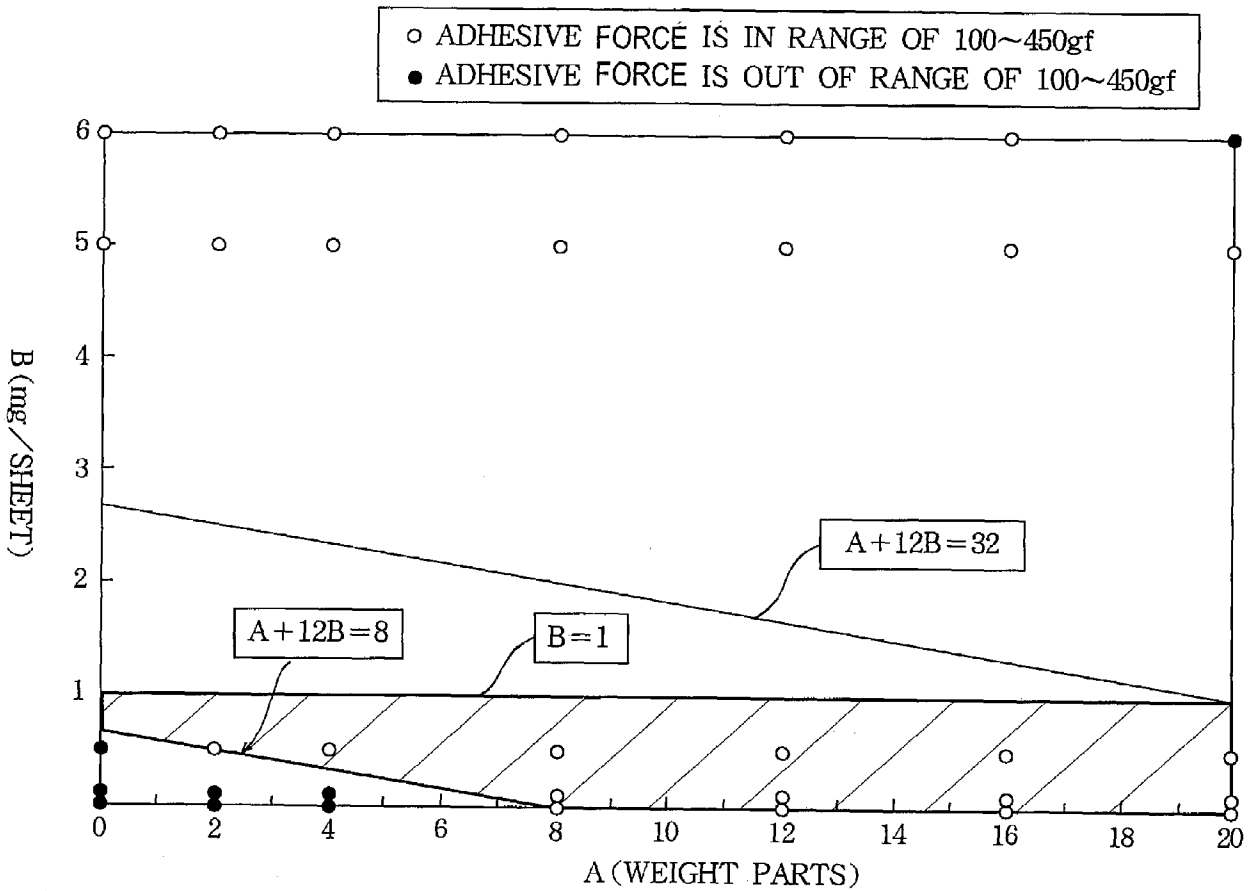
FIG. 7B is a graph showing the relationship between the content of the wax in the toner and the necessary margin.

Because of the above described ranges of the content A of the wax in the toner and the amount B of the applied release agent ($0 \leqq A \leqq 10$ and $0 \leqq B \leqq 1.0$), the preferable range of the content A of the wax and the amount B of the applied release agent is obtained as shown in FIG. 7B. Based on FIG. 7B, it is understood that the relationship of $8 \leqq A+(12 \times B) \leqq 32$ needs to be satisfied, in order to keep the adhesive force in the range from 100 gf to 450 gf even when the amount B of the applied release agent is less than or equals to 1.0 mg/sheet. As a result, the above described relationships (a2), (a3) and (a4) are rewritten as follows:

$$0 \leqq B \leqq 1.0 \quad \text{(a2')}$$

$$8 \leqq A+(12 \times B) \leqq 32 \quad \text{(a3')}$$

$$0 < Rz \leqq 1.0 \quad \text{(a4')}$$

Therefore, the conditions with which the fixing of the borderless image is enabled and the poor fixing is prevented are summarized as follows:

$$0 \leqq A \leqq 10 \quad (1)$$

$$0 \leqq B \leqq 1.0 \quad (2)$$

$$8 \leqq A+(12 \times B) \leqq 32 \quad (3)$$

$$0 < Rz \leqq 1.0 \quad (4)$$

$$0 < Rz/B \leqq 1.0 \quad (5)$$

$$70 \leqq C \leqq 95 \quad (6)$$

$$-20 \leqq D-C \leqq 25 \quad (7)$$

As described above, according to the fixing device of the first embodiment, the above relationships (1) to (7) are satisfied, with the result that the fixing of the borderless image is enabled and the poor fixing is prevented. Additionally, the printing surface does not become coarse, with the result that the lustrous image (for example, a photograph or a poster) can be printed.

The relationships (1) through (7) are obtained by totally studying the experimental results shown in FIGS. 5 through 7B. It is understood that the relationships (1) through (3) regarding the content A of the wax in the toner and the amount B of the applied release agent are particularly important in fixing the borderless image. With the relationships (4) and (5), it becomes possible to print the lustrous image. With the relationships (6) and (7), it becomes possible to use the fixing roller and the pressure roller having the hardness suitable for practical use.

In the above description, the experimental results on the fixing device including the fixing roller 1 and the pressure roller 2 are described. However, by satisfying the relationships (1) to (7), the fixing of the borderless image with high quality is enabled even when the fixing device having the fixing belt 12 (FIG. 3) is used. In this case, Asker C hardness C is measured at the surface (i.e., a fixing surface) of the fixing belt 12. The amount B of the release agent is the amount of the release agent applied to the fixing belt 12 by the release agent applying member 14. The surface roughness Rz is measured at the surface of the release layer of the fixing belt 12.

Second Embodiment

Figure 8:
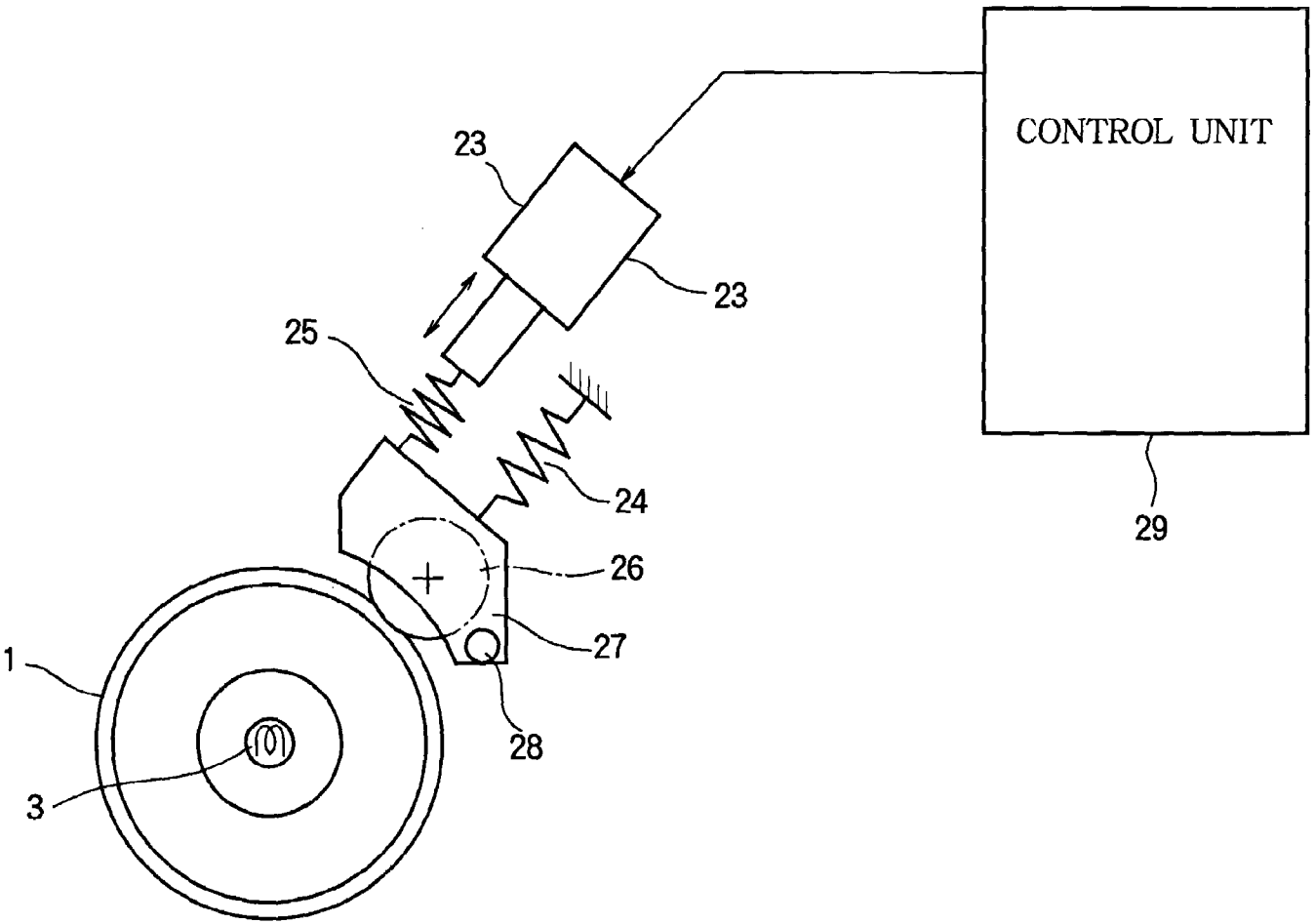
FIG. 8 shows a main part of a fixing device according to the second embodiment of the present invention.

FIG. 8 shows the main part of a fixing device according to the second embodiment of the present invention. The fixing device has a contacting-and-separating mechanism that moves the release agent applying member 26 in contact with the fixing roller 1, and moves the release agent applying member 26 apart from the fixing roller 1. The fixing roller 1 is the same as the fixing roller (FIG. 1) described in the first embodiment, and includes the internal heat source 3. The release agent applying member 26 is composed of, for example, an application roller (disposed in contact with the fixing roller 1) impregnated with the release agent. Alternatively, the release agent applying member 26 can be composed of an application roller (disposed in contact with the fixing roller 1) having a porous surface layer through which the release agent oozes out to be applied to the fixing roller 1. As the release agent, it is possible to employ a material with excellent heat resistance, releasing property and chemical stability such as dimethyl silicone oil, modified dimethyl-silicone oil or fluorine oil.

The release agent applying member 26 is rotatably supported by a supporting body 27. The supporting body 27 is swingably supported by a support shaft 28 fixed to a casing of the fixing device. The supporting body 27 is urged in the direction toward the fixing roller 1 by means of a pressing spring 25, so that the release agent applying member 26 is urged against the fixing roller 1 with a predetermined urging force. The pressing spring 25 is fixed to the tip of a plunger of a solenoid 23. The solenoid 23 drives the plunger toward and away from the fixing roller 1 as shown by an arrow in FIG. 8. The solenoid 23 is controlled by a control unit 29. The plunger projects when the solenoid 23 is turned on, so that the release agent applying member 26 swings about a support shaft 28 and is urged against the fixing roller 1. The plunder retracts when the solenoid 23 is turned off, so that the release agent applying member 26 separates from the fixing roller 1. The supporting body 27 is connected to a stabilizer spring 24 having a spring coefficient smaller than that of the pressing spring 25. One end of the stabilizer spring 24 is fixed to the casing (not shown) of the fixing device, and the other end of the stabilizer spring 24 is fixed to the supporting body 27, so that the stabilizer spring 24 pulls the supporting body 27. The stabilizer spring 24 is provided for holding the pressing spring 25 and the supporting body 27 with high stability while the solenoid is turned off.

The fixing device according to the second embodiment is configured to bring the release agent applying member 26 in contact with the fixing roller 1 by means of the contacting-and-separating mechanism, when a borderless image (i.e., a toner image transferred to the printing medium with no margin left on the perimeter of the printing medium) is to be fixed. Further, the fixing device according to the second embodiment is configured to bring the release agent applying member 26 away from the fixing roller 1 by means of the contacting-and-separating mechanism, when a usual image (i.e., a toner image transferred to the printing medium with a margin left on at least a leading edge of the printing medium in the feeding direction) is to be fixed. Hereinafter, examples of the operation of the fixing device according to the second embodiment will be described.

Figures 9A, 9B, 9C:
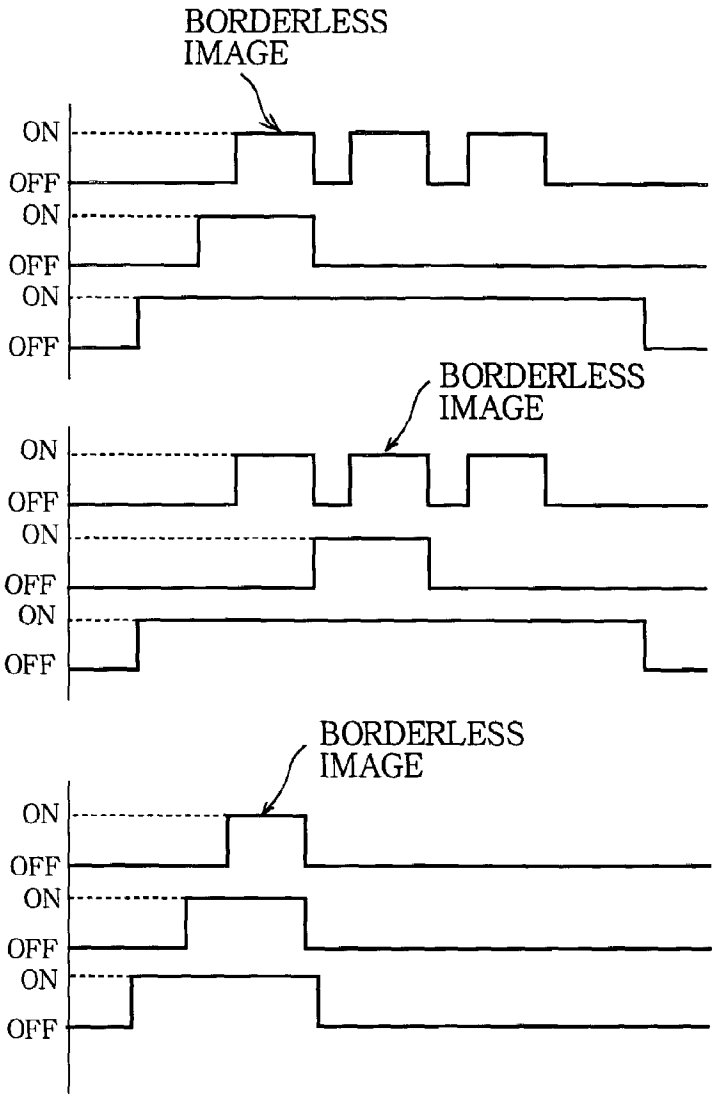
FIGS. 9A, 9B and 9C are timing charts showing operations of the fixing device according to the second embodiment of the present invention.

FIG. 9A is a timing chart illustrating the operation of the fixing device in the case of first printing the borderless image and then printing the usual image. At an initial condition (i.e., before the fixing roller 1 starts rotating), the solenoid 23 is turned off, and therefore the release agent applying member 26 is apart from the fixing roller 1. From this state, the fixing roller 1 starts rotating, and then the solenoid 23 is turned on so that the release agent applying member 26 is urged against the fixing roller 1. With this, the release agent applying member 26 starts applying the release agent to the fixing roller 1. Then, the printing medium (to which the borderless image has been transferred) passes through the nip portion between the fixing roller 1 and the pressure roller 2 (FIG. 2), and the borderless image is fixed to the printing medium. When the fixing is completed, the solenoid 23 is turned off, and the release agent applying member 26 separates from the fixing roller 1. The fixing operation of the following printing medium is carried out without moving the solenoid 23.

FIG. 9B is a timing chart illustrating the operation of the fixing device in the case of first printing the usual image, secondly printing the borderless image, and then printing the usual image. In this case, the fixing roller 1 starts rotating when the release agent applying member 26 separates from the fixing roller 1. As the printing medium (to which the usual image has been transferred) passes through the nip portion between the fixing roller 1 and the pressure roller 2, the usual image is fixed to the printing medium. When the fixing is completed, the solenoid 23 is turned on, and the release agent applying member 26 contacts the fixing roller 1, so that the release agent applying member 26 starts applying the release agent to the fixing roller 1. Then, the printing medium (to which the borderless image has been transferred) passes through the nip portion between the fixing roller 1 and the pressure roller 2, and the borderless image is fixed to the printing medium. When the fixing is completed, the solenoid 23 is turned off, and the release agent applying member 26 separates from the fixing roller 1. The fixing operation of the following printing medium is carried out without moving the solenoid 23.

FIG. 9C is a timing chart illustrating the operation of the fixing device in the case of printing the borderless image and then finishing the operation. In the state where the release agent applying member 26 is apart from the fixing roller 1, the fixing roller 1 starts rotating, and then the solenoid 23 is turned on so that the release agent applying member 26 is urged against the fixing roller 1. With this, the release agent applying member 26 starts applying the release agent to the fixing roller 1. Then, the printing medium to which the borderless image has been transferred passes through the nip portion between the fixing roller 1 and the pressure roller 2, and the borderless image is fixed to the printing medium. When the fixing is completed, the solenoid 23 is turned off so that the release agent applying member 26 separates from the fixing roller 1, and the fixing roller 1 stops rotating.

Figure 10:
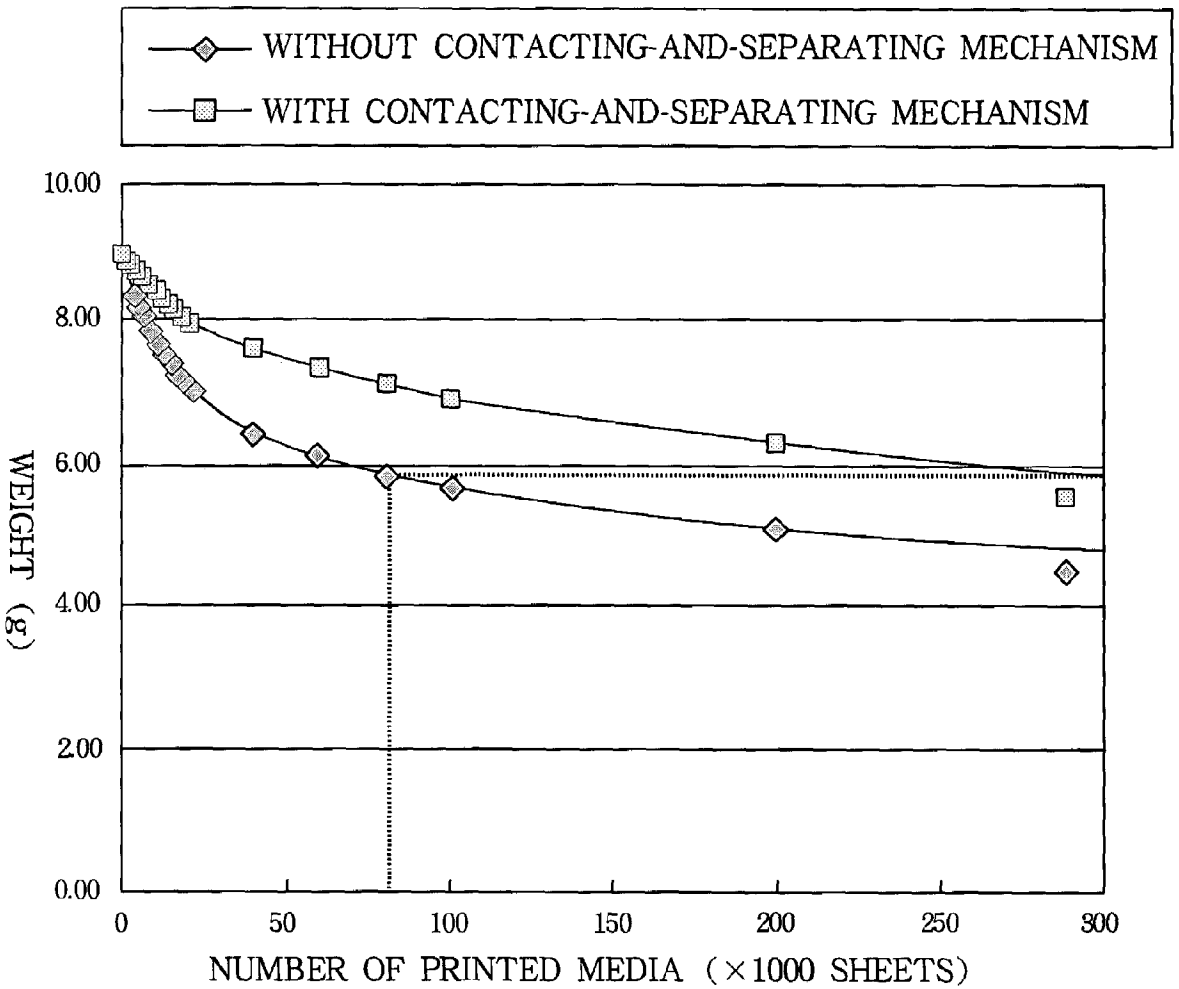
FIG. 10 is a graph showing the effect of the second embodiment of the present invention.

FIG. 10 shows the experimental result comparing the cases with and without the contacting-and-separating mechanism of the release agent applying member. FIG. 10 shows the relationship between the number of printed media and an amount of the release agent that remains in the release agent applying member 26 when the borderless image and the usual image are alternately printed. As shown in FIG. 10, in the case with the contacting-and-separating mechanism, the remaining amount of the release agent when 300000 media (sheets) have been printed is substantially the same as the remaining amount of the release agent when 80000 media (sheets) have been printed without the contacting-and-separating mechanism. This is because, if the contacting-and-separating mechanism is not provided, the release agent gradually oozes out of the release agent applying member 26 to the fixing roller 1. Conversely, if the contacting-and-separating mechanism is provided, the unnecessary consumption of the release agent due to the oozing (when the printing operation is intermitted or when the fixing device is left standing) can be prevented.

As described above, according to the second embodiment, the release agent applying member 26 is kept apart from the fixing roller 1 except during the fixing of the borderless image, and therefore the consumption of the release agent can be reduced when the printing operation is intermitted or when the fixing device is left standing. Therefore, the lifetime of the release agent applying member 26 can be lengthen.

Third Embodiment

Figure 11:
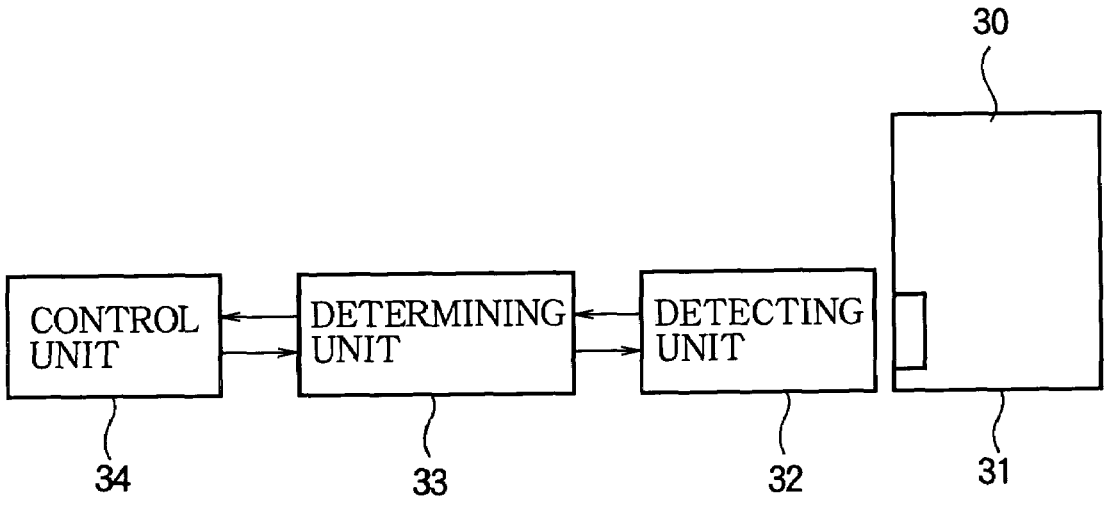
FIG. 11 is a schematic view showing a basic configuration of an image forming apparatus according to the third embodiment of the present invention.

FIG. 11 shows the basic configuration of an image forming apparatus according to the third embodiment of the present invention. In this embodiment, it is possible to selectively attach the fixing device capable of fixing the borderless image as described in the first embodiment and a general fixing device (not capable of fixing the borderless image) to the image forming apparatus. In addition, the fixing device 30 of the third embodiment is provided with an indicator 31 that indicates whether the fixing device 30 is capable of fixing the borderless image or not. The image forming apparatus includes a detecting unit 32 that detects the indicator 31 of the fixing device 30 and outputs a detection signal. The image forming apparatus further includes a determining unit 33 that determines the type of the fixing device 30 based on the detection signal sent from the detecting unit 32. The image forming apparatus further includes a control unit 34 that controls the image forming apparatus according to the determination result of the determining unit 33. FIGS. 12A through 17C illustrate examples of configurations of the indicator 31 and the detecting unit 32.

Figure 12A:
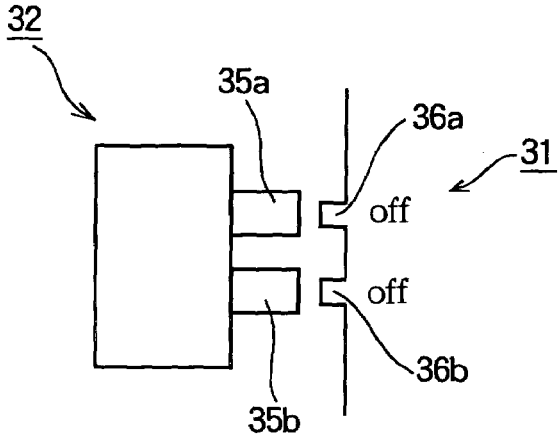
FIGS. 12A and 12B are schematic views showing a first example of the configuration of a detecting unit and an indicator of the image forming apparatus shown in FIG. 11.
Figure 12B:
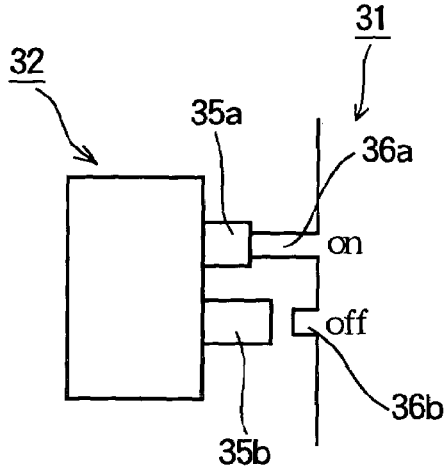

FIGS. 12A and 12B illustrate a first example of the configuration of the indicator 31 and the detecting unit 32. As shown in FIGS. 12A and 12B, the indicator 31 includes a pair of projections 36*a* and 36*b*, and the detecting unit 32 includes a pair of switches 35*a* and 35*b* respectively opposed to the projections 36*a* and 36*b*. The switches 35*a* and 35*b* are mechanical switches, and are turned on and off by depressing. It is preferable that the switches 35*a* and 35*b* are not locked in depressed positions. As shown in FIG. 12A, when the projections 36*a* and 36*b* are both short, the switches 35*a* and 35*b* are not depressed by the projections 36*a* and 36*b*. In this case, both of the switches 35*a* and 35*b* output off signals. Conversely, as shown in FIG. 12B, when one projection 36*a* is long and the other projection 36*b* is short, only the switch 35*a* is depressed. In this case, the switch 35*a* outputs on signal, and the switch 35*b* outputs off signal.

Figure 13A:
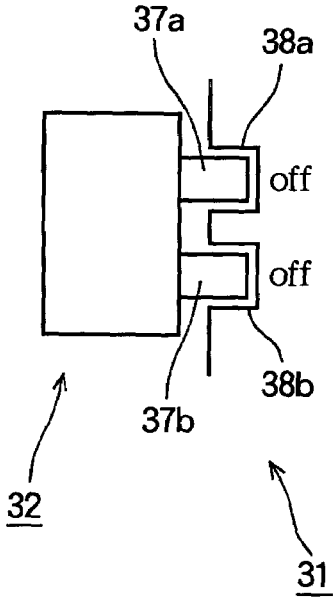
FIGS. 13A and 13B are schematic views showing a second example of the configuration of the detecting unit and the indicator of the image forming apparatus shown in FIG. 11.
Figure 13B:
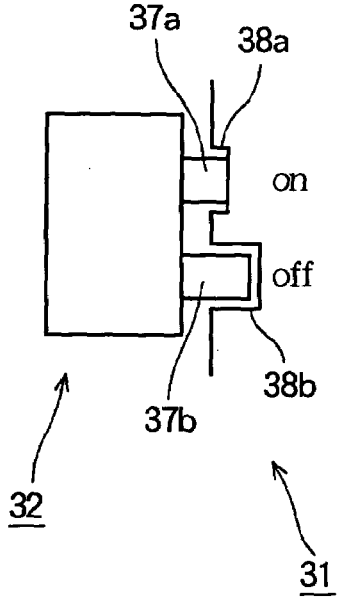

FIGS. 13A and 13B illustrate a second example of the configuration of the indicator 31 and the detecting unit 32. As shown in FIGS. 13A and 13B, the indicator 31 includes a pair of concaves 38*a* and 38*b*, and the detecting unit 32 includes a pair of switches 37*a* and 37*b* respectively opposed to the concaves 38*a* and 38*b*. The switches 37*a* and 37*b* are mechanical switches, and are turned on and off by depressing. It is preferable that the switches 37*a* and 37*b* are not locked in depressed positions. As shown in FIG. 13A, when the concaves 38*a* and 38*b* are both deep, the switches 37*a* and 37*b* are not depressed by the concaves 38*a* and 38*b*. In this case, both of the switches 37*a* and 37*b* output off signals. Conversely, as shown in FIG. 13B, when one concave 38*a* is shallow and the other concave 38*b* is deep, only the switch 37*a* is depressed. In this case, the switch 37*a* outputs on signal, and the switch 37*b* outputs off signal.

Figure 14A:
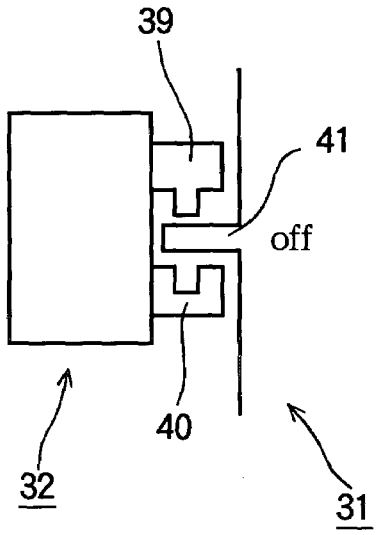
FIGS. 14A and 14B are schematic views showing a third example of the configuration of the detecting unit and the indicator of the image forming apparatus shown in FIG. 11.
Figure 14B:
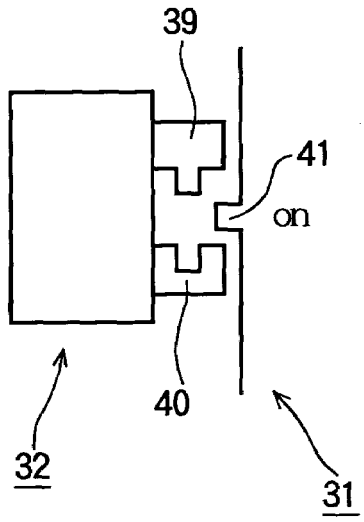

FIGS. 14A and 14B illustrate a third example of the configuration of the indicator 31 and the detecting unit 32. As shown in FIGS. 14A and 14B, the detecting unit 32 includes a light emitting element 39 and a light receiving element 40, and the indicator 31 includes a shielding plate 41. The light emitting element 39 can be composed of a light emitting diode (LED), a light bulb or the like. The light receiving element 40 can be composed of a photo diode, a photo transistor, a cadmium cell, a solar cell or the like. As shown in FIG. 14A, when the shielding plate 41 is long, the shielding plate 41 interrupts a light pass between the light emitting element 39 and the light receiving element 40. In this case, the intensity of the light incident on the light receiving element 40 is lower than a predetermined value. Conversely, as shown in FIG. 14B, when the shielding plate 41 is short, the shielding plate 41 does not interrupt the light pass. In this case, the intensity of the light incident on the light receiving element 40 is higher than the predetermined value.

Figure 15A:
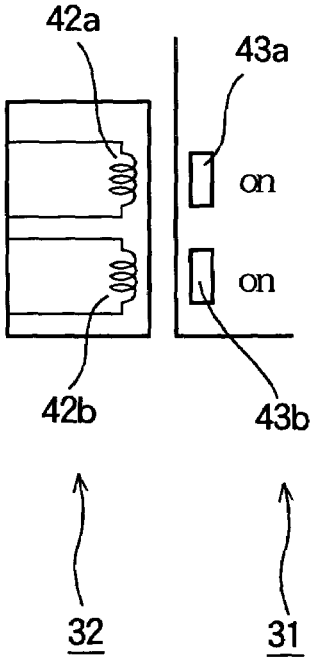
FIGS. 15A and 15B are schematic views showing a fourth example of the configuration of the detecting unit and the indicator of the image forming apparatus shown in FIG. 11.
Figure 15B:
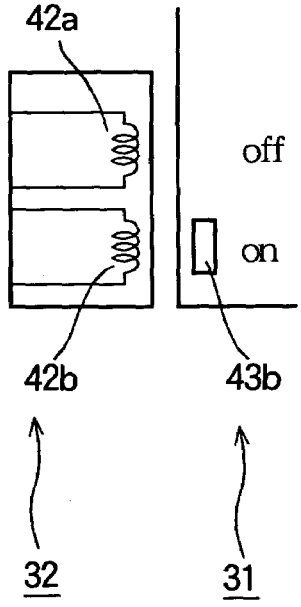

FIGS. 15A and 15B illustrate a fourth example of the configuration of the indicator 31 and the detecting unit 32. As shown in FIGS. 15A and 15B, the indicator 31 includes an iron piece 43*b* (FIG. 15B) or a pair of iron pieces 43*a* and 43*b* (FIG. 15A), and the detecting unit 32 includes a pair of coils 42*a* and 42*b*. The coils 42*a* and 42*b* can be composed of general coil elements whose inductance range from several μH to several hundreds mH. Instead of the iron pieces, it is also possible to use nickel, cobalt, manganese, chrome or the like, individually or in the form of ferromagnetic alloy. Alternatively, it is also possible to use ferromagnetic alloy to which aluminum, cupper, tungsten, samarium, neodymium, silicon, tellurium or the like is added. Further, it is also possible to use sintered body of ferrite or the like. In this example, on and off signals are outputted on the principle that the inductance of the coil changes when the iron piece approaches the coil. For example, if the inductance of the coil is approximately 10 mH, the inductance is reduced by 10% when the iron piece moves to the position of 1 mm from the coil. Conversely, if the iron piece is replaced with the ferromagnetic body (such as ferrite), the inductance of the coil increases when the piece of ferromagnetic body moves close to the coil. It is determined whether the rise time of the voltage between both ends of each coil (when a pulse current flows through each coil) is delayed in comparison with a predetermined rise time. As shown in FIG. 15A, when the coils 42*a* and 42*b* face the iron pieces 43*a* and 43*b*, the inductances of the coils 42*a* and 42*b* are at Low level. Conversely, as shown in FIG. 15B, when the coil 42*a* does not face the iron piece and the coil 42*b* faces the iron piece 43*b*, the inductance of the coil 42*a* is at High level, and the inductance of the coil 42*b* is at Low level.

Figure 16A:
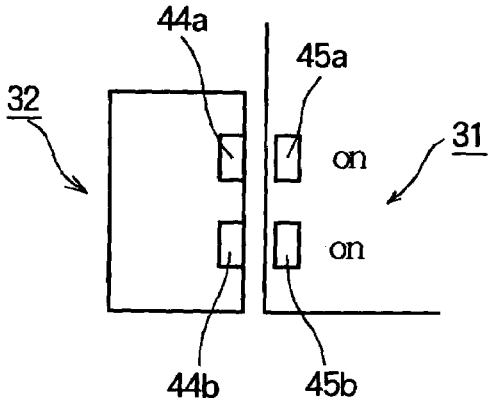
FIGS. 16A and 16B are schematic views showing a fifth example of the configuration of the detecting unit and the indicator of the image forming apparatus shown in FIG. 11.
Figure 16B:
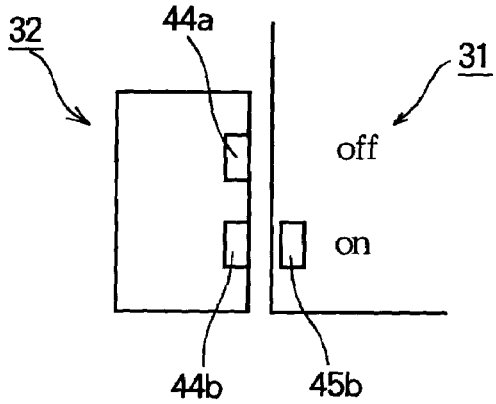

FIGS. 16A and 16B illustrate a fifth example of the configuration of the indicator 31 and the detecting unit 32. As shown in FIGS. 16A and 16B, the indicator 31 includes a magnet piece 45*b* (FIG. 16B) or a pair of magnet pieces 45*a* and 45*b* (FIG. 16A), and the detecting unit 32 includes a pair of magnetic sensors 44*a* and 44*b*. As the magnet pieces 45*a* and 45*b*, it is possible to use alloy magnet of carbon steel, tungsten steel, KS steel (permanent magnet steel), aluminum, cupper, nickel, cobalt or the like. It is also possible to use rare-earth cobalt magnet. As the magnetic sensor, it is possible to use semiconductor magnetic sensor such as Hall element. As shown in FIG. 16A, when the magnetic sensors 44*a* and 44*b* face the magnet pieces 45*a* and 45*b*, the magnetic field detected by the magnetic sensors 44*a* and 44*b* are higher than the predetermined value. Conversely, as shown in FIG. 16B, when the magnetic sensor 44*a* does not face the magnet piece and the magnetic sensor 44*b* faces the magnet piece 45*b*, the magnetic field detected by the magnetic sensor 44*a* is lower than the predetermined value, and the magnetic field detected by the magnetic sensor 44*b* is higher than the predetermined value.

Figure 17A:
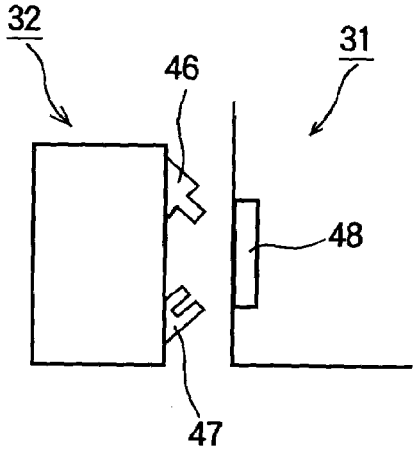
FIGS. 17A, 17B and 17*c* are schematic views showing sixth, seventh and eighth examples of the configuration of the detecting unit and the indicator of the image forming apparatus shown in FIG. 11.

FIG. 17A illustrates a sixth example of the configuration of the indicator 31 and the detecting unit 32. As shown in FIG. 17A, the indicator 31 includes a reflection surface 48, and the detecting unit 32 includes a light emitting element 46 and a light receiving element 47. As the light emitting element 46, it is possible to use a light emitting diode, a light bulb or the like. As the light receiving element 47, a photo diode, photo transistor, cadmium cell, a solar cell or the like. It is necessary that the reflection surface 48 has the surface reflectance of 0 to 1.0 and has excellent long-term stability. As the reflection surface 48, it is possible to use paper, resin, metal, glass, tile, coating or the like. Further, it is also possible to use a polished part of casing of the fixing device 30, or a member that changes an angle of the light incident on the light receiving element 47. In this case, the intensity of the light incident on the light receiving element 47 changes according to the reflectance of the reflection surface 48, and therefore it is possible to determine the type of the fixing device 30 based on whether the intensity of the incident light is higher than the predetermined value or not.

Figure 17B:
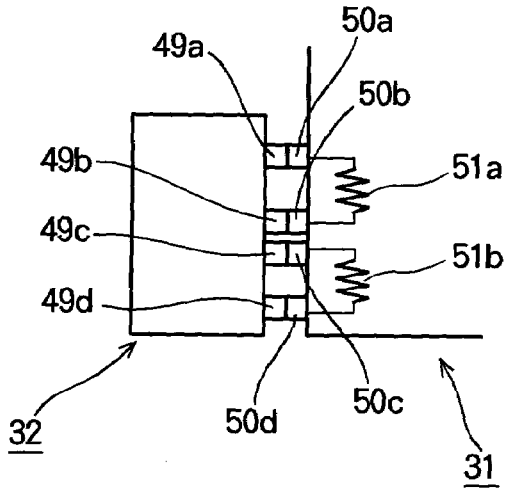

FIG. 17B illustrates a seventh example of the configuration of the indicator 31 and the detecting unit 32. As shown in FIG. 17B, the indicator 31 includes four terminals 50*a*, 50*b*, 50*c* and 50*d*, and the detecting unit 32 includes four terminals 49*a*, 49*b*, 49*c* and 49*d*. A load resistance 51*a* is connected to the terminals 50*a* and 50*b*, and another load resistance 51*b* is connected to the terminals 50*c* and 50*d*. The terminals 49*a* through 49*d* and the terminals 50*a* through 50*d* are necessarily conductive when the terminals 49*a* through 49*d* contact the terminals 50*a* through 50*d*. As the terminals 49*a* through 49*d* and the terminals 50*a* through 50*d*, it is possible to use a material having a high conductivity such as gold, silver, cupper, nickel, aluminum. However, it is preferable to use brass in terms of corrosion resistance and cost. As the load resistances 51*a* and 51*b*, it is possible to use general electrical resistors having the electric resistance of several Ω to several GΩ. In this case, by allowing the current to flow between the terminals 49*a* and 49*b* and between the terminals 49*c* and 49*d*, it is possible to determine the type of the fixing device 30 based on whether the electric resistances at the load resistance 51*a* and 51*b* are higher than a predetermined value or not.

Figure 17C:
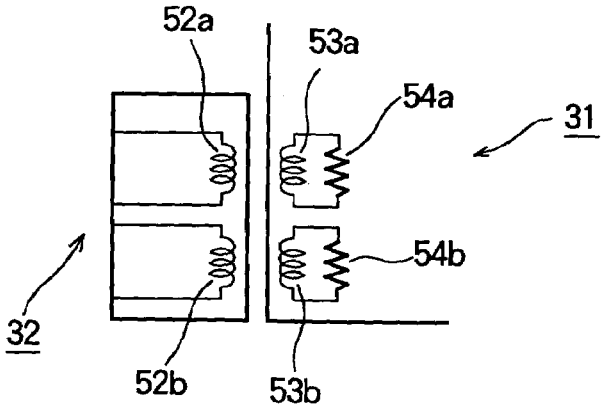

FIG. 17C illustrates an eighth example of the configuration of the indicator 31 and the detecting unit 32. As shown in FIG. 17C, the indicator 31 includes two coils 53*a* and 53*b* respectively connected to load resistances 54*a* and 54*b*, and the detecting unit 32 includes two coils 52*a* and 52*b*. As the coils 52*a*, 52*b*, 53*a* and 53*b*, it is possible to use general resistors having the inductance from several μH to several hundreds mH. As the load resistances 54*a* and 54*b*, it is possible to use general resistors having the electric resistance from several Ω to several G Ω. In this case, the inductances of the coils 52*a* and 52*b* change in accordance with the winding directions or inductances of the coils 53*a* and 53*b* or the electric resistances of the load resistances 54*a* and 54*b*, and therefore it is possible to determine the type of the fixing device 30 based on the inductance as was described with reference to FIGS. 15A and 15B.

Next, the operation of the image forming apparatus according to the third embodiment will be described. The control unit 34 instructs the determining unit 33 to determine the type of the fixing device 30, when the main power of the image forming apparatus is turned on, or when a part of a casing of the image forming apparatus is opened and closed for replacing the fixing device 30 while the main power is kept to be on. The determining unit 33 sends the determination instruction signal to the detecting unit 32. The detecting unit 32 outputs the detection signal described with reference to FIGS. 12A through 17C, in accordance with the indicator 31 of the fixing device 30 attached to the image forming apparatus. The determining unit 33 determines whether the attached fixing device 30 is the fixing device capable of fixing borderless image (1) or the general fixing device (0) as described later, and sends the signal of the determination result to the control unit 34. The control unit 34 allows the borderless printing only when the attached fixing device 30 is capable of fixing the borderless image, in accordance with the signal from the determining unit 33.

TABLES. 1 through 5 show the examples of the determination carried out by the determining unit 33.

TABLE 1

| TYPE | SW1 | SW2 | DETERMINATION RESULT |
|---|---|---|---|
| GENERAL FIXING DEVICE | off | off | 0 |
| FIXING DEVICE CAPABLE OF FIXING BORDERLESS IMAGE | on | off | 1 |

TABLE. 1 corresponds to the examples shown in FIGS. 12A and 12B and FIGS. 13A and 13B. The switch SW1 corresponds to the switch 35*a* shown in FIGS. 12A and 12B or the switch 37*a* shown in FIGS. 13A and 13B. The switch SW2 corresponds to the switch 35*b* shown in FIGS. 12A and 12B or the switch 37*b* shown in FIGS. 13A and 13B. When the outputs from the switches SW1 and SW2 are both off, the determining unit 33 determines that the attached fixing device 30 is the general fixing device. When the output from the switches SW1 and SW2 are respectively on and off, the determining unit 33 determines that the attached fixing device 30 is capable of fixing the borderless image.

TABLE 2

| TYPE | LIGHT INTENSITY | DETERMINATION RESULT |
|---|---|---|
| GENERAL FIXING DEVICE | LOW | 0 |
| FIXING DEVICE CAPABLE OF FIXING BORDERLESS IMAGE | HIGH | 1 |

TABLE. 2 corresponds to the examples shown in FIGS. 14A and 14B and FIG. 17A. When the intensity of the light incident on the light receiving element 40 (47) is higher than the predetermined value, the determining unit 33 determines that the attached fixing device 30 is the general fixing device. When the intensity of the light incident on the light receiving element 40 (47) is lower than the predetermined value, the determining unit 33 determines that the attached fixing device 30 is capable of fixing the borderless image.

TABLE 3

| TYPE | Z1 | Z2 | DETERMINATION RESULT |
|---|---|---|---|
| GENERAL FIXING DEVICE | LOW | LOW | 0 |
| FIXING DEVICE CAPABLE OF FIXING BORDERLESS IMAGE | HIGH | LOW | 1 |

TABLE. 3 corresponds to the examples shown in FIGS. 15A and 15B and FIG. 17C. The inductance Z1 is the inductance of the coil 42*a* shown in FIGS. 15A and 15B or the inductance of the coil 52*a* shown in FIG. 17C. The inductance Z2 is the inductance of the coil 42*b* shown in FIGS. 15A and 15B or the inductance of the coil 52*b* shown in FIG. 17C. When the inductances Z1 and Z2 are both LOW, the determining unit 33 determines that the attached fixing device 30 is the general fixing unit. When the inductances Z1 and Z2 are respectively HIGH and LOW, the determining unit 33 determines that the attached fixing device 30 is capable of fixing the borderless image.

TABLE 4

| TYPE | G1 | G2 | DETERMINATION RESULT |
|---|---|---|---|
| GENERAL FIXING DEVICE | STRONG | STRONG | 0 |
| FIXING DEVICE CAPABLE OF FIXING BORDERLESS IMAGE | WEAK | STRONG | 1 |

TABLE. 4 corresponds to the examples shown in FIGS. 16A and 16B. The magnetic field G1 is detected by the magnetic sensor 44*a* shown in FIGS. 16A and 16B. The magnetic field G2 is detected by the magnetic sensor 44*b* shown in FIGS. 16A and 16B. When the magnetic fields G1 and G2 are both stronger than the predetermined value, the determining unit 33 determines that the attached fixing device 30 is the general fixing device. When the magnetic field G1 is weaker than the predetermined value, and when the magnetic field G2 is stronger than the predetermined value, the determining unit 33 determines that the attached fixing device 30 is capable of fixing the borderless image.

TABLE 5

| TYPE | R1 | R2 | DETERMINATION RESULT |
|---|---|---|---|
| GENERAL FIXING DEVICE | LOW | LOW | 0 |
| FIXING DEVICE CAPABLE OF FIXING BORDERLESS IMAGE | HIGH | LOW | 1 |

TABLE. 5 corresponds to the examples shown in FIG. 17B. The resistance R1 is the resistance of the load resistance 51*a* shown in FIG. 17B. The resistance Z2 is the resistance of the load resistance 51*b* shown in FIG. 17B in FIG. 17C. When the resistances R1 and R2 are both LOW, the determining unit 33 determines that the attached fixing device 30 is the general fixing device. When the resistances Z1 and Z2 are respectively HIGH and LOW, the determining unit 33 determines that the attached fixing device is capable of fixing the borderless image.

As described above, according to the third embodiment, whether the fixing device attached to the image forming apparatus is capable of fixing the borderless image or not is determined, and the borderless printing is allowed only when the fixing device is capable of fixing the borderless image. Thus, for example, in the case where the image forming apparatus is provided with the general fixing device as a standard equipment and the fixing device capable of fixing the borderless image is prepared as an option, it is possible to prevent the borderless printing from being mistakenly carried out when the general fixing device is attached to the image forming apparatus. Therefore, it is possible to prevent a trouble such as a poor fixing or a winding of the printing medium.

Figure 18:
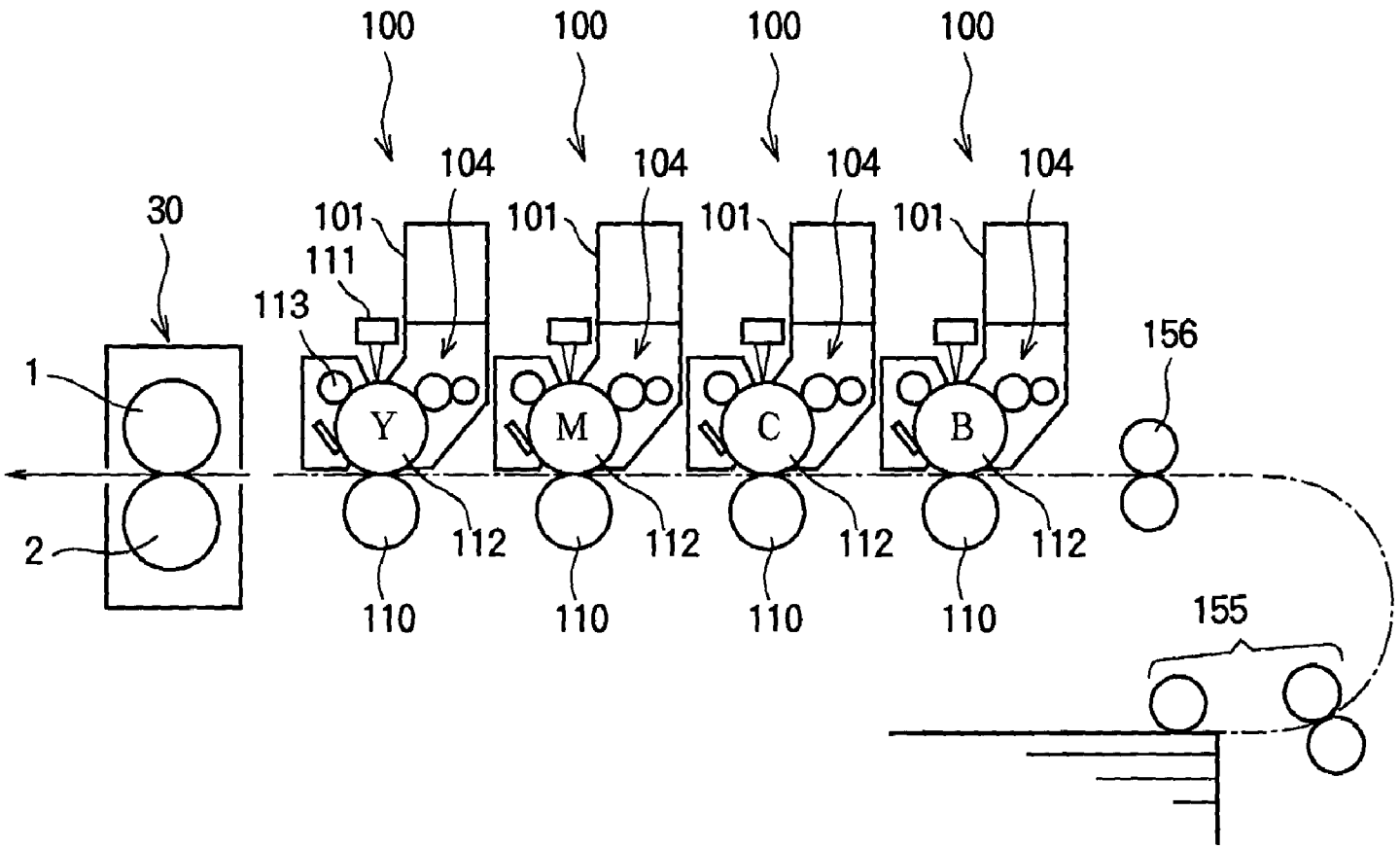
FIG. 18 is a schematic view showing an example of the image forming apparatus to which the fixing devices of the first, second and third embodiments can be applied.

FIG. 18 is a schematic view showing an example of an image forming apparatus to which the fixing device of the first, second or third embodiment is applied. The image forming apparatus includes four image forming units 100 of yellow (Y), magenta (M), cyan (C) and black (B) arranged along a feeding path of the printing medium. Each of the image forming units 100 includes a photosensitive drum 112, a charging roller 113, a printing head 111, a developing device 104 and a cleaning blade 114. Four transfer rollers 110 are disposed in opposition to the photosensitive drums 112 via the feeding path. The fixing device 30 according to the first, second or third embodiment is disposed on the downstream side of the image forming units 100.

The printing medium is supplied by a medium supply device 155, and is fed to feeding rollers 156 provided on the upstream side of the image forming units 100. The feeding rollers 156 correct the skewing of the printing medium, and feed the printing medium to the image forming units 100 along the feeding path. While the printing medium is fed along the feeding path through the image forming units 100, the toner images of four colors are respectively transferred to the printing medium. In each of the image forming units 100, the photosensitive drum 112 rotates, the charging roller 113 uniformly charges the surface of the photosensitive drum 112, and the printing head 111 exposes the surface of the photosensitive drum 112 to form the latent image thereon. The developing device 104 develops the latent image with toner, so that the toner image is formed on the photosensitive drum 112. The toner image is transferred to the printing medium by the transfer roller 110, and the residual toner on the surface of the photosensitive drum 112 is removed by the cleaning blade 114. Then, the printing medium is fed to the fixing device 30, and is heated and pressed by the fixing roller 1 and the pressure roller 2, so that the toner image is fixed to the printing medium. After the toner image is fixed to the printing medium, the printing medium is ejected out of the image forming apparatus.

The present invention is applicable to an image forming apparatus such as a copier, a printer, a facsimile capable of printing a monochrome image or color image including a plurality of colors.

While the preferred embodiments of the present invention have been illustrated in detail, it should be apparent that modifications and improvements may be made to the invention without departing from the spirit and scope of the invention as described in the following claims.

What is claimed is:

1. A fixing device comprising:

a fixing member;

a heat source for heating said fixing member;

a pressure member urged against said fixing member so as to form a nip portion between said pressure member and said fixing member; and a release agent applying unit that applies a release agent to said fixing member or said pressure member, wherein said fixing member and said pressure member heat and press a printing medium that bears a toner image at said nip portion so as to fix said toner image to said printing medium, and wherein an amount A (weight parts) of a wax contained in said toner, and an amount B (mg/sheet) of said release agent applied to said fixing member or said pressure member by said release agent applying unit per printing medium of A4 size satisfy the following relationships (1) through (3):

$$0 \leqq A \leqq 20 \quad (1)$$

$$0 \leqq B \leqq 1.0 \quad (2)$$

$$8 \leqq A+(12 \times B) \leqq 32 \quad (3), \text{ and}$$

wherein a surface roughness Rz (μm) of said fixing member satisfies the following relationships:

$$0 < Rz \leqq 1.0 \quad (4)$$

$$0 < Rz/B \leqq 1.0 \quad (5).$$

2. The fixing device according to claim 1, wherein said toner image is formed on said printing medium in such a manner that no margin is formed on a perimeter of said printing medium, or a margin less than or equals to 2 mm is formed on said perimeter of said printing medium.

3. The fixing device according to claim 1, wherein said fixing member has a release layer on a surface thereof.

4. The fixing device according to claim 1, wherein a force necessary to separate said printing medium having passed said nip portion from a surface of said fixing member is less than or equals to 450 gf.

5. The fixing device according to claim 1, wherein said fixing member is in the form of a roller.

6. The fixing device according to claim 1, wherein said fixing member is in the form of a belt.

7. The fixing device according to claim 1, wherein said release agent applying member includes a roller having a porous surface in which said release agent is held.

8. The fixing device according to claim 1, wherein said printing medium bears an unfixed toner image of a plurality of colors.

9. The fixing device according to claim 1, further comprising a contacting-and-separating mechanism that moves said release agent applying member in contact with said pressure member and moves said release agent applying member apart from said pressure member.

10. A fixing device comprising:

a fixing member;

a heat source for heating said fixing member;

a pressure member urged against said fixing member so as to form a nip portion between said pressure member and said fixing member; and a release agent applying unit that applies a release agent to said fixing member or said pressure member, wherein said fixing member and said pressure member heat and press a printing medium that bears a toner image at said nip portion so as to fix said toner image to said printing medium, and wherein an amount A (weight parts) of a wax contained in said toner, and an amount B (mg/sheet) of said release agent applied to said fixing member or said pressure member by said release agent applying unit per printing medium of A4 size satisfy the following relationships (1) through (3):

$$0 \leqq A \leqq 20 \quad (1)$$

$$0 \leqq B \leqq 1.0 \quad (2)$$

$$8 \leqq A+(12 \times B) \leqq 32 \quad (3), \text{ and}$$

wherein an Asker C hardness C of a surface of said fixing member and an Asker C hardness D of a surface of said pressure member satisfy the following relationships:

$$70 \leqq C \leqq 95 \quad (6)$$

$$-20 \leqq D-C \leqq 25 \quad (7).$$

11. A fixing device comprising:

a fixing member;

a heat source for heating said fixing member;

a pressure member urged against said fixing member so as to form a nip portion between said pressure member and said fixing member;

a release agent applying unit that applies a release agent to said fixing member or said pressure member, wherein said fixing member and said pressure member heat and press a printing medium that bears a toner image at said nip portion so as to fix said toner image to said printing medium; and an indicator indicating that said fixing device is capable of borderless printing in which no margin is formed at a perimeter of said printing medium or a margin is formed on a limited area from said perimeter of said printing medium, wherein an amount A (weight parts) of a wax contained in said toner, and an amount B (mg/sheet) of said release agent applied to said fixing member or said pressure member by said release agent applying unit per printing medium of A4 size satisfy the following relationships (1) through (3):

$$0 \leqq A \leqq 20 \quad (1)$$

$$0 \leqq B \leqq 1.0 \quad (2)$$

$$8 \leqq A+(12 \times B) \leqq 32 \quad (3).$$

12. An image forming apparatus to which said fixing device according to claim 11 is attachable, said image forming apparatus including:

a detecting unit that detects said indicator and outputs a detection signal regarding the type of said fixing device;

a determining unit that determines the type of said fixing device in accordance with said detection signal, and a control unit that allows or prohibits a borderless printing in accordance with a determination result of said determining unit, wherein said control unit allows said borderless printing only when said determining unit determines that said fixing device is capable of borderless printing.

* * * * *